US012435522B2

(12) United States Patent
Maertens et al.

(10) Patent No.: US 12,435,522 B2
(45) Date of Patent: Oct. 7, 2025

(54) WALL OR CEILING PANELS AND WALL OR CEILING COVERING

(71) Applicant: Flooring Industries Limited, SARL, Bertrange (LU)

(72) Inventors: Luc Maertens, Ardooie (BE); Mark Cappelle, Staden (BE); Caroline Van De Populiere, Moen (BE); Lode De Boe, Moorslede (BE)

(73) Assignee: UNILIN BV, Wielsbeke (BE)

( * ) Notice: Subject to any disclaimer, the term of this patent is extended or adjusted under 35 U.S.C. 154(b) by 471 days.

(21) Appl. No.: 17/760,379

(22) PCT Filed: Jan. 14, 2021

(86) PCT No.: PCT/IB2021/050251

§ 371 (c)(1),
(2) Date: Aug. 9, 2022

(87) PCT Pub. No.: WO2021/161112

PCT Pub. Date: Aug. 19, 2021

(65) Prior Publication Data

US 2023/0106580 A1 Apr. 6, 2023

(30) Foreign Application Priority Data

Feb. 10, 2020 (BE) ..... 2020/5076

(51) Int. Cl.

| | |
|---|---|
| ***E04F 13/08*** | (2006.01) |
| ***E04F 13/10*** | (2006.01) |
| ***E04F 13/18*** | (2006.01) |

(52) U.S. Cl.
CPC ..... *E04F 13/0894* (2013.01); *E04F 13/0841* (2013.01); *E04F 13/10* (2013.01);
(Continued)

(58) Field of Classification Search
CPC ... E04F 13/0894; E04F 13/0841; E04F 13/10; E04F 13/18; E04F 2201/0115;
(Continued)

(56) References Cited

U.S. PATENT DOCUMENTS

| | | | |
|---|---|---|---|
| 1,052,670 A | 2/1913 | La Francis | |
| 2006/0010820 A1 | 1/2006 | Schwitte et al. | |
| 2020/0018076 A1* | 1/2020 | Fahle | E04F 13/0826 |

FOREIGN PATENT DOCUMENTS

| | | |
|---|---|---|
| DE | 102005058105 B3 | 2/2007 |
| EP | 2454425 A2 | 5/2012 |

(Continued)

OTHER PUBLICATIONS

Search Report from corresponding Belgian Application No. BE 2020/5076, Nov. 19, 2020.

(Continued)

*Primary Examiner* — Gisele D Ford
(74) *Attorney, Agent, or Firm* — Workman Nydegger

(57) ABSTRACT

A rectangular panel which, on the first and on the second pair of opposite edges, has coupling parts configured for easy installation in a wall or ceiling covering. A locking occurs between the coupled panels; and a wall or ceiling covering that includes such panels.

15 Claims, 12 Drawing Sheets

(52) U.S. Cl.
CPC ..... *E04F 13/18* (2013.01); *E04F 2201/0115* (2013.01); *E04F 2201/0161* (2013.01); *E04F 2201/023* (2013.01); *E04F 2201/042* (2013.01); *E04F 2201/043* (2013.01); *E04F 2201/044* (2013.01)

(58) Field of Classification Search
CPC ..... E04F 2201/0161; E04F 2201/023; E04F 2201/042; E04F 2201/043; E04F 2201/044
See application file for complete search history.

(56) References Cited

FOREIGN PATENT DOCUMENTS

| | | | |
|---|---|---|---|
| IT | UD20090024 | A1 | 8/2010 |
| WO | 02052113 | A2 | 7/2002 |
| WO | 2019003100 | A1 | 1/2019 |

OTHER PUBLICATIONS

International Search Report from PCT Application No. PCT/IB2021/050251, Jul. 14, 2021.

* cited by examiner

WALL OR CEILING PANELS AND WALL OR CEILING COVERING

BACKGROUND

The invention relates to rectangular wall or ceiling panels with coupling parts at their four edges, and also to wall or ceiling coverings that comprise such wall or ceiling panels. The invention further relates to a method for installing such a wall or ceiling covering; and an attachment element for use in this method.

Wall and ceiling panels are known, for example, from WO2019/003100A1. The wall or ceiling panels of WO2019/003100A1—referred to hereinafter simply as "panel"—are of the type that comprises a male coupling part on a side edge of the panel and a female coupling part on AN opposite side edge of the panel, wherein the coupling parts are configured such that two of such panels, by means of the coupling parts, can be coupled to each other in a plane and a coupled state can thus be realized between the panels; wherein the male coupling part comprises a tongue and the female coupling part comprises a groove, which tongue and groove, in the coupled state, form a tongue and groove connection that realizes a mechanical locking between the panels in the direction perpendicular to the plane of the panels; wherein the groove is delimited by a front lip and a rear lip; and wherein each of the coupling parts comprises a locking part, which locking parts, in the coupled state, realize a mechanical locking between the panels in the direction in the plane of the panels and perpendicular to the side edges. The locking parts, in the coupled state, thus counteract the moving apart of the tongue and the groove in the direction in the plane of the coupled panels and perpendicular to the side edges.

In this context, the term "mechanical locking" refers to locking carried out in a mechanical manner. In order to realize the locking, therefore, there is no need for adhesive or the like. However, it is not excluded for adhesive or the like to be used in the coupling. For example, adhesive or the like can be used in order to reinforce the locking or to counteract the penetration of water into the coupling.

Wall and ceiling panels are also known from the document WO2002/052113A2. According to this document, the panels are fastened to a hard and flat substructure and coupled to one another. The substructure is composed, for example, of wood or metal. Now, it is apparent that coupling of the panels to one another is not risk-free. Insertion of the male coupling part into the female coupling part does not always take place smoothly. The male coupling part must often be forced into the female coupling part using a certain amount of force. This means that there is a chance that the coupling parts will be damaged. This damage can cause the locking between the panels not to be optimal or even to fail.

SUMMARY

An object of the invention is to provide wall and ceiling panels that can be easily installed, preferably even by one person. A further object of the invention is to provide the wall and ceiling coverings installed with these panels with high-quality surfaces so that they can be painted without further preprocessing. A further object of the invention is to provide a method for the simple installation of such panels—for example by one person, even with large dimensions—in a simple and high-quality manner, also and primarily in walls or ceilings with larger surfaces.

The first, second, third and fourth aspect of the invention relate to a wall or ceiling panel. The panel is rectangular, either square or oblong. The panel comprises a first pair of opposite edges; namely a first edge and a second edge. The first edge comprises a first male coupling part. The second edge comprises a first female coupling part. The first male coupling part and the first female coupling part are configured such that two of such panels, by means of their first male and first female coupling parts, can be coupled to each other in a plane and a coupled state can thus be realized between the panels. The first male coupling part comprises a first tongue. The first female coupling part comprises a first groove. The first groove is delimited by a first front lip and a first rear lip. Preferably, the first rear lip extends in a distal direction beyond the open or free end of the first front lip. The first tongue and the first groove, in the coupled state, form a tongue and groove connection that realizes a mechanical locking between the panels in the direction perpendicular to the plane of the panels. The first male coupling part and the first female coupling part each comprise a first locking part. These first locking parts, in the coupled state, realize a mechanical locking between the panels in the direction in the plane of the panels and perpendicular to the first pair of opposite edges. The first locking part of the first male coupling part is provided on the rear side of the first tongue. The first locking part of the first female coupling part is provided on the front side of the first rear lip.

The panel comprises a second pair of opposite edges; namely a third edge and a fourth edge. The third edge comprises a second male coupling part. The fourth edge comprises a second female coupling part. The second male coupling part and the second female coupling part are configured such that two of such panels, by means of their second male and second female coupling parts, can be coupled to each other in a plane and a coupled state can thus be realized between the panels. The second male coupling part comprises a second tongue. The second female coupling part comprises a second groove. The second groove is delimited by a second front lip and a second rear lip. Preferably, the second rear lip extends in a distal direction beyond the open or free end of the second front lip. The second tongue and the second groove, in the coupled state, form a tongue and groove connection that realizes a mechanical locking between the panels in the direction perpendicular to the plane of the panels. The second male coupling part and the second female coupling part each comprise a second locking part, which second locking parts, in the coupled state, realize a mechanical locking between the panels in the direction in the plane of the panels and perpendicular to the second pair of opposite edges. The second locking part of the second male coupling part is provided on the rear side of the second tongue. The second locking part of the second female coupling part is provided on the front side of the second rear lip.

The panel in accordance with the first aspect of the invention is characterized in that the length of the first locking part of the first rear lip measured in the direction perpendicular to the second edge and in the plane parallel to the front edge of the panel is greater than the length of the second locking part of the second rear lip measured in the direction perpendicular to the fourth edge and in the plane parallel to the front edge of the panel. An advantage of panels in accordance with the first aspect of the invention is that they can more easily be installed in ceiling and wall coverings, even by only one person, to make high-quality ceiling or wall coverings. These coverings can be painted in a high-quality manner without further processing. More specifically, such panels can be easily installed by means of fastening clips on the second edges of the panels, wherein no clips are used on the second pair of opposite edges.

The panel in accordance with the second aspect of the invention is characterized in that the distance measured perpendicular to the plane of the panel between the front point of the first locking part of the first female coupling part and the rear point on the front edge of the first rear lip is greater than the distance measured perpendicular to the plane of the panel between the front point of the second locking part of the second female coupling part and the rear point on the front edge of the second rear lip.

Preferably, the panel in accordance with the second aspect of the invention is configured in accordance with the first aspect of the invention.

An advantage of panels in accordance with the second aspect of the invention is that they can more easily be installed in ceiling and wall coverings, even by only one person, to make high-quality ceiling or wall coverings. These coverings can be painted in a high-quality manner without further processing. More specifically, such panels can be easily installed by means of fastening clips on the second edges of the panels, wherein no clips are used on the second pair of opposite edges.

The panel in accordance with the third aspect of the invention is characterized in that the front edge of the first locking part of the first female coupling part is parallel to the surface of the panel over at least half of its length—and preferably over at least 75% of its length—as measured in the direction in the plane of the panel and perpendicular to the second edge of the panel. The front edge of the second locking part of the second female coupling part is curved over at least half of its length—and preferably over its entire length—as measured in the direction in the plane of the panel and perpendicular to the fourth edge of the panel. An advantage of panels in accordance with the third aspect of the invention is that they can more easily be installed in ceiling and wall coverings, even by only one person, to make high-quality ceiling or wall coverings. These coverings can be painted in a high-quality manner without further processing. More specifically, such panels can be easily installed by means of fastening clips on the second edges of the panels, wherein no clips are used on the second pair of opposite edges.

Preferably, the panel in accordance with the third aspect of the invention is configured in accordance with the first aspect of the invention and/or in accordance with the second aspect of the invention.

The panel in accordance with the fourth aspect of the invention is characterized in that the first rear lip, on the rear side thereof, is provided with a first recess. The second rear lip, on the rear side thereof, does not comprise a recess; or the second rear lip on its rear side is provided with a second recess, wherein this second recess extends from the open or free end of the second rear lip in the direction perpendicular to the fourth edge and in the plane parallel to the surface of the panel over a shorter distance than the distance over which the first recess extends from the open or free end of the first rear lip in the direction perpendicular to the second edge and in the plane parallel to the surface of the panel.

An advantage of panels in accordance with the fourth aspect of the invention is that they can more easily be installed in ceiling and wall coverings, even by only one person, to make high-quality ceiling or wall coverings. These coverings can be painted in a high-quality manner without further processing. More specifically, such panels can be easily installed by means of fastening clips on the second edges of the panels, wherein no clips are used on the second pair of opposite edges.

Preferably, the panel in accordance with the fourth aspect of the invention is configured in accordance with the first aspect of the invention and/or in accordance with the second aspect of the invention and/or in accordance with the third aspect of the invention.

In preferred embodiments of the fourth aspect of the invention, the first recess runs in the direction in the plane of the panel and perpendicular to the edge of the panel that comprises the first rear lip over at least a part of the recess parallel to the surface of the panel. Preferably, the front edge of the first locking part of the first female coupling part is parallel to the surface of the panel over at least a part of the length of the first recess where this recess is parallel to the surface of the panel.

In preferred embodiments of the fourth aspect of the invention, the first recess runs in the direction in the plane of the panel and perpendicular to the second edge of the panel over at least a part of the recess parallel to the surface of the panel.

In preferred embodiments of the fourth aspect of the invention, the first recess, over at least half of its length as measured in the plane of the panel and perpendicular to the second edge of the panel, is parallel to the plane of the front side of the panel.

In preferred embodiments of the fourth aspect of the invention, the first recess extends from the open or free end of the first rear lip to past the first locking part of the first female coupling part.

In preferred embodiments in accordance with the first and/or second and/or third and/or fourth aspect of the invention, the panel is oblong, and the first pair of opposite edges is provided on the long edges of the panel.

In preferred embodiments in accordance with the first and/or second and/or third and/or fourth aspect of the invention, the first edge comprises a first stop surface perpendicular to the plane of the panel; wherein this first stop surface extends up to the front edge of the panel. The second edge comprises a second stop surface perpendicular to the plane of the panel; wherein this second stop surface extends up to the front edge of the panel. In a coupled state of two such panels at their first pair of opposite edges, the first stop surface lies against the second stop surface. The third edge comprises a third stop surface perpendicular to the plane of the panel; wherein this third stop surface extends up to the front edge of the panel. The fourth edge comprises a fourth stop surface perpendicular to the plane of the panel; wherein this fourth stop surface extends up to the front edge of the panel. In a coupled state of two such panels at their second pair of opposite edges, the third stop surface lies against the fourth stop surface.

The fifth aspect of the invention relates to a wall or ceiling panel, optionally such as in one or more of the first aspect, the second aspect, the third aspect or the fourth aspect of the invention, wherein the panel is rectangular, either square or oblong, wherein the panel comprises a first pair of opposite edges, namely a first edge and a second edge; wherein the first edge comprises a first male coupling part, wherein the second edge comprises a first female coupling part, wherein the first male coupling part and the first female coupling part are configured such that two of such panels, by means of their first male and first female coupling parts, can be coupled to each other in a plane and a coupled state can thus be realized between the panels; wherein the first male coupling part comprises a first tongue; wherein the first female coupling part comprises a first groove, wherein the first groove is delimited by a first front lip and a first rear lip; preferably wherein the first rear lip extends in a distal direction beyond the open or free end of the first front lip; wherein the first tongue and the first groove, in the coupled state, form a tongue and groove connection that realizes a mechanical locking between the panels in the direction perpendicular to the plane of the panels; wherein the first male coupling part and the first female coupling part each comprise a first locking part, which first locking parts, in the coupled state, realize a mechanical locking between the panels in the direction in the plane of the panels and perpendicular to the first pair of opposite edges; wherein the first locking part of the first male coupling part is provided on the rear side of the first tongue; wherein the first locking part of the first female coupling part is provided on the front side of the first rear lip; wherein the first locking part of the first female coupling part, distal to the location of the first locking part of the first female coupling part that is closest to the surface of the panel, comprises a zone that is parallel to the surface of the panel or that makes an angle of inclination of at most 5° with the surface of the panel, wherein this zone accounts for at least half—and preferably more than 60%—of the length of the first locking part of the first female coupling part measured in the direction perpendicular to the second edge. Such wall or ceiling panels are advantageous in that on the first female coupling part, space is made for a clip for fastening the panel to a base, without this affecting the minimum thickness of the panel.

In a preferred embodiment of the fifth aspect of the invention, the entire zone, in the direction perpendicular to the plane of the panel, is at least 0.3 mm—and preferably at least 0.4 mm, and more preferably at least 0.5 mm—lower than the location of the first locking part of the first female coupling part that is closest to the surface of the panel. In this manner, space is efficiently created for a clip by means of which the panel can be fastened to a base, without this affecting the minimum thickness of the panel.

In a preferred embodiment of the fifth aspect of the invention, the first locking part of the female coupling part, on the side facing the surface of the panel, comprises a step, wherein the zone that is parallel to the surface of the panel or that makes an angle of inclination of at most 5° with the surface of the panel is distal to this step and wherein the location of the first locking part of the female coupling part that is closest to the surface of the panel lies proximal to this step. This step elegantly creates the necessary space for fastening the panel to a base by means of a clip, without this affecting the minimum thickness of the panel.

In a preferred embodiment of the fifth aspect of the invention, the location of the first locking part of the first female coupling part that is closest to the surface of the panel is situated in a section of the first locking part of the first female coupling part that is parallel to the surface of the panel.

In a preferred embodiment of the fifth aspect of the invention, the panel comprises a second pair of opposite edges; namely a third edge and a fourth edge; wherein the third edge and the fourth edge do not comprise coupling parts. This embodiment can be advantageously used for example in wall panels with a floor-to-ceiling configuration.

In a preferred embodiment of the fifth aspect of the invention, the panel comprises a second pair of opposite edges; namely a third edge and a fourth edge; wherein the third edge comprises a second male coupling part, wherein the fourth edge comprises a second female coupling part, wherein the second male coupling part and the second female coupling part are configured such that two of such panels, by means of their second male and second female coupling parts, can be coupled to each other in a plane and a coupled state can thus be realized between the panels; wherein in a coupled state, a locking of the coupled panels is formed in the direction perpendicular to the plane of the coupled panels and also in the direction perpendicular to the coupled edges in the direction parallel to the plane of the coupled panels.

In preferred embodiment of the first aspect, the second aspect, the third aspect, the fourth aspect or the fifth aspect of the invention, the first edge, proximal to the first locking part of the first male coupling part, comprises a recess—preferably parallel to the surface of the panel—wherein this recess, perpendicular with respect to the surface of the panel, has a depth of at least 0.4 mm, and preferably a depth of at least 0.5 mm, and at most 1 mm; wherein the length of the recess in the direction perpendicular to the first edge is at least 0.3 mm, and preferably at least 0.5 mm Such embodiments create space, for example for placing the head of a nail or the head of a screw by means of which a clip is fastened to the base. This clip fastens the panel to a base.

In preferred embodiments in accordance with the first and/or second and/or third and/or fourth and/or fifth aspect of the invention, the first rear lip is configured such that the first rear lip, or at least a part thereof, can bend backwards, even if the panel or the first rear lip is attached to a flat substructure. Such embodiments facilitate installation of the panels.

In preferred embodiments in accordance with the first and/or second and/or third and/or fourth and/or fifth aspect of the invention, the rear edge of the first rear lip, in the part that extends further than the first front lip, lies partially in the plane of the rear edge of the panel. Such embodiments make it possible to fasten the panel to a substructure by nailing, stapling, or screwing it tight.

In preferred embodiments in accordance with the first and/or second and/or third and/or fourth and/or fifth aspect of the invention, the panel shows one or a combination of two or more of the following characteristics:

- the panel has a length of at least 2400 mm and the panel shows one or a combination of two or more of the following characteristics:
- the panel has a width-to-length ratio greater than 1/10;
- the panel comprises a water-resistant front and/or rear side;
- the panel comprises on the front and/or rear side a melamine layer;
- the panel comprises on the front and/or rear side a lacquer layer, for example an acrylic-based, preferably UV-cured lacquer layer;
- the panel comprises on the front and/or rear side a watertight foil, such as e.g. a PVC (polyvinyl chloride) foil, a PET (polyethylene terephthalate) foil, or a PP (polypropylene) foil;
- the panel comprises as a core a waterproof material, for example a core based on a filled or unfilled plastic, such as filled PVC.

In preferred embodiments in accordance with the first and/or second and/or third and/or fourth and/or fifth aspect of the invention, the panel shows one or a combination of two or more of the following characteristics:

- the active locking zone defined by the first locking parts is situated, partially or fully, beyond the open or free end of the first front lip;

the part of the first rear lip that extends in a distal direction beyond the open or free end of the first front lip is longer than the thickness of the panel;

the first male coupling part and the first female coupling part are configured such that they can be coupled by means of an angling movement, preferably with a snap or click effect;

the first male coupling part and the first female coupling part are configured such that they can be coupled by means of a horizontal movement with a snap effect of one panel with respect to another such panel;

the first male coupling part and the first female coupling part are configured such that in the coupled state, they fit into each other with pretension; and/or the first male coupling part and the first female coupling part are made completely from the material of the panel, and in one part therewith.

In preferred embodiments in accordance with the first and/or second and/or third and/or fourth and/or fifth aspect of the invention, the panel shows one or more of the following features:

the active locking zone defined by the second locking parts is situated, partially or fully, beyond the open or free end of the second front lip;

the part of the second rear lip that extends in a distal direction beyond the open or free end of the first front lip is longer than the thickness of the panel;

the second male coupling part and the second female coupling part are configured such that they can be coupled by means of an angling movement, preferably with a snap or click effect;

the second male coupling part and the second female coupling part are configured such that they can be coupled by means of a horizontal movement with a snap effect of one panel with respect to another such panel;

the second male coupling part and the second female coupling part are configured such that in the coupled state, they fit into each other with pretension; and/or the second male coupling part and the second female coupling part are made completely from the material of the panel, and in one part therewith.

In preferred embodiments in accordance with the first and/or second and/or third and/or fourth and/or fifth aspect of the invention, the panel shows one or more of the following features:

the panel has a length between 1000 mm and 1500 mm;

the panel has a width between 300 and 450 mm;

the thickness of the panel is between 5 and 15 mm;

the panel is wood-based;

the panel comprises as a core a wood fiberboard, such as an MDF or HDF board;

the panel has a decorative front and/or rear side;

the panel is of the DPL or HPL type; and/or the panel has a finishable front and/or rear side, with for example a lacquer carrying sheet;

the panel comprises a substrate, wherein this substrate comprises polyvinyl chloride, and optionally a filler, for example a mineral filler or a wood-based or cellulose-based filler;

the panel comprises a substrate, wherein this substrate comprises a matrix, wherein this matrix is formed by a mineral binder—for example magnesium oxide or gypsum—and optionally wherein this substrate comprises one or more fillers.

The sixth aspect of the invention relates to a wall or ceiling covering. This covering comprises a plurality of wall or ceiling panels in accordance with any embodiment of the first and/or second and/or third and/or fourth and/or fifth aspect of the invention. The covering comprises a substructure, and the substructure preferably comprises parallel laths and at least one fastening clip. More preferably, the parallel laths are positioned perpendicular to the first pair of opposite edges. The at least one fastening clip is fastened to the substructure; preferably to the parallel laths if these are present in the substructure. The at least one fastening clip is configured with an opening. The at least one fastening clip is fastened to the substructure. The opening is slid over at least a part of the first locking part of the first female coupling part of a first such panel. A second such panel is coupled by means of its first male coupling part to the first female coupling part of this first such panel. A third such panel is coupled at its third edge to the fourth edge of the first such panel by means of their respective coupling parts at their third and fourth edges. Preferably, no fastening clips are provided on the second pair of opposite edges of the panels.

The seventh aspect of the invention relates to a wall or ceiling covering comprising a plurality of wall or ceiling panels, a substructure and at least one fastening clip. The panels are rectangular, either square or oblong. The panels comprise a first pair of opposite edges; namely a first edge and a second edge. The first edge comprises a first male coupling part. The second edge comprises a first female coupling part. The first male coupling part and the first female coupling part are configured such that two of such panels, by means of their first male and first female coupling parts, can be coupled to each other in a plane and a coupled state can thus be realized between the panels. The first male coupling part comprises a first tongue. The first female coupling part comprises a first groove. The first groove is delimited by a first front lip and a first rear lip. Preferably, the first rear lip extends in a distal direction beyond the open or free end of the first front lip. The first tongue and the first groove form, in the coupled state, a tongue and groove connection that realizes a mechanical locking between the panels in the direction perpendicular to the plane of the panels. The first male coupling part and the first female coupling part each comprise a first locking part. These first locking parts, in the coupled state, realize a mechanical locking between the panels in the direction in the plane of the panels and perpendicular to the first pair of opposite edges. The first locking part of the first male coupling part is provided on the rear side of the first tongue. The first locking part of the first female coupling part is provided on the front side of the first rear lip. The at least one fastening clip is configured with an opening. The at least one fastening clip is fastened to the substructure. The opening is slid over at least a part of one of the edges of a first such panel; preferably over at least a part of the first edge or over at least a part of the second edge. A second such panel is coupled by means of its first male coupling part to the first female coupling part of this first such panel. The wall or ceiling unit is characterized in that the at least one fastening clip is fastened to the substructure such that the fastening clip can slide with respect to the substructure in the direction perpendicular to the first pair of opposite edges and in the plane of the panel on expansion of the panel in the direction perpendicular to the first pair of opposite edges and parallel to the plane of the panel.

In wall or ceiling coverings in accordance with the seventh aspect of the invention, the fastening of the panels with the clips can absorb expansion of the panels—for example with increased humidity—in the direction transverse to the first pair of opposite edges, because the fastening clip can slide with respect to the substructure in the direction perpendicular to the first pair of opposite edges and parallel to the plane of the panel.

In preferred embodiments of the seventh aspect of the invention, no fastening clips are provided on the second pair of opposite edges of the panels.

In preferred embodiments of the seventh aspect of the invention, the opening of the at least one fastening clip is slid over at least a part of the first locking part of the first female coupling part of a first such panel.

In preferred embodiments of the invention the panels comprise a second pair of opposite edges; namely a third edge and a fourth edge. The third edge comprises a second male coupling part. The fourth edge comprises a second female coupling part. The second male coupling part and the second female coupling part are configured such that two of such panels, by means of their second male and second female coupling parts, can be coupled to each other in a plane and a coupled state can thus be realized between the panels. The second male coupling part comprises a second tongue. The second female coupling part comprises a second groove. The second groove is delimited by a second front lip and a second rear lip. Preferably, the second rear lip extends in a distal direction beyond the open or free end of the second front lip. The second tongue and the second groove, in the coupled state, form a tongue and groove connection that realizes a mechanical locking between the panels in the direction perpendicular to the plane of the panels. The second male coupling part and the second female coupling part each comprise a second locking part. These second locking parts, in the coupled state, realize a mechanical locking between the panels in the direction in the plane of the panels and perpendicular to the second pair of opposite edges. The second locking part of the second male coupling part is provided on the rear side of the second tongue. The second locking part of the second female coupling part is provided on the front side of the second rear lip. A third such panel is coupled with its third edge to the fourth edge of the first such panel by means of their respective coupling parts at their third and fourth edges.

In preferred embodiments of the seventh aspect of the invention, the wall or ceiling panels are wall or ceiling panels in accordance with the first and/or second and/or third and/or fourth and/or fifth aspect of the invention.

In preferred embodiments of the seventh aspect of the invention, the panels comprise a second pair of opposite edges; namely a third edge and a fourth edge. The third edge comprises a second male coupling part. The fourth edge comprises a second female coupling part. The second male coupling part and the second female coupling part are configured such that two of such panels, by means of their second male and second female coupling parts, can be coupled to each other in a plane and a coupled state can thus be realized between the panels; by means of a mostly vertical—with respect to the plane of the thus coupled panels—coupling motion of the one panel with respect to the other panel, wherein a third such panel is coupled at its third edge to the fourth edge of the first such panel by means of their respective coupling parts at their third and fourth edges, wherein the thus coupled panels are locked to each other in the plane parallel to the surface of the panels and perpendicular to the second pair of opposite edges; and perpendicular to the surface of the coupled panels.

In an example of such a preferred embodiment, the second male coupling part of the panel is configured as a hook-shaped component facing toward the rear side of the panel, referred to hereinafter as a locking hook. The second female coupling part is configured as a hook-shaped component facing toward the front side of the panel, referred to hereinafter as a receiving hook. More preferably, the hook-shaped components are produced mainly from the material of the core of the panels, and are mainly configured to form a single piece therewith. The locking hook comprises a lip that is provided with a locking component extending toward the rear side of the panel. The receiving hook comprises a lip that is provided with a locking component extending toward the front side of the panel. The locking components in the coupled state work in conjunction such that they at least bring about the locking in the direction parallel to the surface of the panels and perpendicular to the second pair of opposite edges. The second male coupling part and the second female coupling part comprise further locking parts for the locking in the direction perpendicular to the plane of the panel. More preferably, the further locking parts comprise a separate insert piece or insert, more preferably a movable insert or movable separate insert piece. On the coupling of the panel at its third edge to the fourth edge of another such panel, a movement of or into the insert or insert piece brings about the locking in the direction perpendicular to the plane of the thus coupled panels.

The eighth aspect of the invention relates to a wall or ceiling covering. The covering comprises a plurality of wall or ceiling panels, a substructure and at least one fastening clip. The panels are rectangular, either square or oblong. The panels comprise a first pair of opposite edges—preferably on the long sides of the panel; namely a first edge and a second edge. The first edge comprises a first male coupling part, the first male coupling part preferably comprises a first tongue. The second edge comprises a first female coupling part, the first female coupling part preferably comprises a first groove; more preferably, the first groove is delimited by a first front lip and a first rear lip; even more preferably, the first rear lip extends in a distal direction beyond the open or free end of the first front lip. Preferably, the first male coupling part comprises locking parts and the first female coupling part comprises locking parts for interaction with the locking parts of the first male coupling part of a coupled panel in order to realize a locking of thus coupled panels in the direction perpendicular to the plane of the coupled panels. The first male coupling part and the first female coupling part are configured such that a first such panel can be mutually coupled at its first edge to the second edge of a second such panel in a plane by means of an angling movement of the first such panel with respect to the second such panel; wherein a locking of the thus coupled panels is obtained both in the direction in the plane of the panels and perpendicular to the thus coupled edges as well as in the direction perpendicular to the surface of the thus coupled panels. The at least one fastening clip is configured with an opening. The at least one fastening clip is fastened to the substructure. The opening is slid over at least a part of a first edge of a first panel or over at least a part of a second edge of a second panel, wherein this first edge is coupled to this second edge. The panels comprise a second pair of opposite edges; namely a third edge and a fourth edge. The third edge comprises a second male coupling part, the first male coupling part preferably comprises a second tongue. The fourth edge comprises a second female coupling part. Preferably, the second female coupling part comprises a second groove; more preferably, the second groove is delimited by a second front lip and a second rear lip; even more preferably, the second rear lip extends in a distal direction beyond the open or free end of the second front lip. Preferably, the second male coupling part comprises locking parts and the second female coupling part comprises locking parts for interaction with the locking parts of the second coupling part of a coupled panel in order to realize a locking of thus coupled panels in the direction perpendicular to the plane of the coupled panels, wherein the second male coupling part and the second female coupling part are configured such that a third such panel can be mutually coupled at its third edge to the fourth edge of a fourth such panel in a plane by means of a movement parallel to the plane of the panels of the third such panel with respect to the fourth such panel; wherein this movement parallel to the plane of the panels brings about a snap effect; and wherein a locking of the thus coupled panels is obtained both in the direction in the plane of the panels and perpendicular to the thus coupled edges as well as in the direction perpendicular to the surface of the thus coupled panels. The at least one fastening clip is fastened to the substructure such that the fastening clip can slide with respect to the substructure in the direction perpendicular to the first edge and in the plane of the panel on expansion of the panel in the direction perpendicular to the first edge and parallel to the plane of the panel.

In wall or ceiling coverings in accordance with this aspect of the invention, the fastening of the panels with the clips can absorb expansion of the panels—for example with increased humidity—in the direction transverse to the first pair of opposite edges, because the fastening clip can slide with respect to the substructure in the direction perpendicular to the first pair of opposite edges and parallel to the plane of the panel.

The ninth aspect of the invention relates to a wall or ceiling covering. The covering comprises a plurality of wall or ceiling panels, a substructure and at least one fastening clip. The panels are rectangular, either square or oblong. The panels comprise a first pair of opposite edges—preferably on the long sides of the panel; namely a first edge and a second edge. The first edge comprises a first male coupling part. Preferably, the first male coupling part comprises a first tongue. The second edge comprises a first female coupling part. Preferably, the first female coupling part comprises a first groove. More preferably, the first groove is delimited by a first front lip and a first rear lip. Even more preferably, the first rear lip extends in a distal direction beyond the open or free end of the first front lip. Preferably, the first male coupling part comprises locking parts and the first female coupling part comprises locking parts for interaction with the locking parts of the first male coupling part of a coupled panel in order to realize a locking of thus coupled panels in the direction perpendicular to the plane of the coupled panels. The first male coupling part and the first female coupling part are configured such that a first such panel can be mutually coupled at its first edge to the second edge of a second such panel in a plane by means of an angling movement of the first such panel with respect to the second such panel; wherein a locking of the thus coupled panels is obtained both in the direction in the plane of the panels and perpendicular to the thus coupled edges as well as in the direction perpendicular to the surface of the thus coupled panels. The at least one fastening clip is configured with an opening. The at least one fastening clip is fastened to the substructure. The opening is slid over at least a part of a first edge of a first panel or over at least a part of a second edge of a second panel, wherein this first edge is coupled to this second edge. The panels comprise a second pair of opposite edges; namely a third edge and a fourth edge. The third edge comprises a second male coupling part. The fourth edge comprises a second female coupling part. Preferably, the second male coupling part comprises locking parts and the second female coupling part comprises locking parts for interaction with the locking parts of the second coupling part of a coupled panel in order to realize a locking of thus coupled panels in the direction perpendicular to the plane of the coupled panels. The second male coupling part and the second female coupling part are configured such that a third such panel can be mutually coupled at its third edge to the fourth edge of a fourth such panel in a plane; wherein, by means of this coupling, a locking of the thus coupled panels is obtained both in the direction in the plane of the panels and perpendicular to the thus coupled edges as well as in the direction perpendicular to the surface of the thus coupled panels. This coupling can be carried out by means of a movement parallel to the plane of the panels of the third such panel with respect to the fourth such panel; wherein this movement parallel to the plane of the panels brings about a snap effect and/or wherein this coupling can be carried out by means of a movement of the third such panel substantially perpendicular with respect to the surface of the fourth such panel. The at least one fastening clip is fastened to the substructure such that the fastening clip can slide with respect to the substructure in the direction perpendicular to the first edge and in the plane of the panel on expansion of the panel in the direction perpendicular to the first edge and parallel to the plane of the panel.

In wall or ceiling coverings in accordance with this aspect of the invention, the fastening of the panels with the clips can absorb expansion of the panels—for example with increased humidity—in the direction transverse to the first pair of opposite edges, because the fastening clip can slide with respect to the substructure in the direction perpendicular to the first pair of opposite edges and parallel to the plane of the panel.

In preferred embodiments in accordance with the seventh, eighth or ninth aspect of the invention, the fastening clip is fastened by means of a fastening device—e.g. a screw—to the substructure, such that the fastening clip can slide relatively with respect to the fastening device on expansion of the panel in the direction perpendicular to the first edge and parallel to the plane of the panel.

More preferably, the fastening clip possesses a slotted hole. The fastening device—for example a screw—runs through this slotted hole. The slotted hole is directed perpendicular to the second edge. The fastening clip can slide with respect to the fastening device and with respect to the substructure on expansion of the panel in the direction perpendicular to the first edge and parallel to the plane of the panel.

Preferably, the fastening clip is fastened with a screw via the slotted hole to the substructure, wherein a collar—preferably of plastic—is provided between the head of the screw and the fastening clip. In this manner, there is no contact of the screw with the fastening clip, but there is between the collar—preferably of plastic—and the fastening clip; which makes sliding of the fastening clip with respect to the screw easier.

In preferred embodiments in accordance with the seventh, eighth or ninth aspect of the invention, the fastening clip is kept suspended in a second clip. This second clip is fastened—preferably in a non-slideable manner—to the substructure, for example by means of one or more fastening means, for example one or more screws, staples or rivets. The fastening clip can slide with respect to the second clip and with respect to the substructure on expansion of the panel in the direction perpendicular to the first edge and parallel to the plane of the panel.

Preferably, the fastening clip and the second clip are configured such that—preferably after fastening of the second clip to the substructure—the fastening clip is brought into the second clip by means of a sliding motion or by means of a rotary motion.

More preferably, such a wall or ceiling covering comprises a plurality of fastening clips and a plurality of second clips. Preferably, the fastening clips and the second clips are provided as sets of one fastening clip each with one specific second clip each. This means that each fastening clip is attached with its own specific second clip. This also means that as many fastening clips as second clips are preferably used.

In preferred embodiments in accordance with the seventh, eighth or ninth aspect of the invention, the panels are rectangular and oblong, wherein the first pair of opposite edges are the long edges of the panels.

In preferred embodiments in accordance with the sixth, seventh, eighth or ninth aspect of the invention, the at least one fastening clip comprises a base arm, a front arm and a rear arm. The opening is situated between the front arm and the rear arm. The base arm is fastened to the substructure by means of one or more fastening elements—for example one or more screws, one or more nails, one or more staples, one or more rivets, or an adhesive joint.

Preferably, the rear arm, over at least a part thereof, is in line with at least a part of the base arm.

Preferably, the rear arm does not come into contact with the first such panel.

Preferably, the base arm does not come into contact with panels of the wall or ceiling covering.

Preferably, the rear arm is configured to keep the rear side of the first such panel over its entire surface at a distance from the substructure that is greater than the thickness of the rear arm. More preferably, for this purpose, the rear arm comprises a step-shaped component.

Preferably, the base arm is configured to keep the rear side of the second such panel over its entire surface at a distance from the substructure that is greater than the thickness of the base arm. Preferably, for this purpose, the base arm comprises a step-shaped component.

Preferably, on the rear edge of the opening, there is at least 0.55 mm—and more preferably at least 0.8 mm; and even more preferably at least 1 mm—of clearance between the rear edge of the first locking part of the first female coupling part. These embodiments allow the lip of the first female coupling part to be easily bent during the coupling of a panel to this first female coupling part.

Preferably, there is an open space between the rear edge of at least a part of the second rear lip of the first panel and the substructure, such that the second rear lip of the first panel or at least a part thereof can bend backwards on and/or during the coupling of the third panel by means of its third coupling parts to the fourth coupling parts of the first panel.

In preferred embodiments of the sixth, seventh, eighth or ninth aspect of the invention, the front edge of the wall or ceiling panels is painted after fastening of the wall or ceiling panels to the substructure.

In preferred embodiments of the sixth, seventh, eighth or ninth aspect of the invention, the substructure comprises one or more laths—preferably parallel laths, wherein the at least one fastening clip is fastened to the one or more laths. More preferably, these parallel laths are positioned perpendicular to the first edges of the panels.

It is noted that in accordance with the sixth, seventh, eighth and ninth aspect of the invention, along the edge of a panel—and preferably along the second edge of the panels—more fastening clips can be attached, preferably at more or less regular intervals from one another.

In preferred embodiments of the sixth, seventh, eighth and ninth aspect of the invention, no fastening clips are provided on the second pair of opposite edges of the panels.

The tenth aspect of the invention is a kit for the installation of a wall or ceiling covering in accordance with any embodiment of the seventh, eighth or ninth aspect of the invention. The kit comprises a plurality of wall or ceiling panels; preferably wall or ceiling panels in accordance with any embodiment of the first, second, third, fourth or fifth aspect of the invention. The kit comprises at least one—and preferably more than one—fastening clip for the installation of a wall or ceiling covering in accordance with any embodiment of the seventh, eighth or ninth aspect of the invention.

The eleventh aspect of the invention is a kit for the installation of a wall or ceiling covering in accordance with any embodiment of the invention, wherein the fastening clip is kept suspended in a second clip, wherein this second clip—preferably in a non-slideable manner—is fastened to the substructure. The kit comprises a plurality of wall or ceiling panels; preferably wall or ceiling panels in accordance with any embodiment of the first, second, third, fourth or fifth aspect of the invention. The kit comprises at least one—and preferably more than one—fastening clip; and at least one—and preferably more than one—second clip, for the installation of a wall or ceiling covering in accordance with any of the claims in accordance with any embodiment of the invention wherein the fastening clip is kept suspended in a second clip, wherein this second clip—preferably in a non-slideable manner—is fastened to the substructure.

The twelfth aspect of the invention is a method for the installation of a wall or ceiling covering, preferably a wall or ceiling covering in accordance with any embodiment of the sixth, seventh, eighth or ninth aspect of the invention. The wall or ceiling covering comprises a plurality of panels; preferably wall or ceiling panels in accordance with any embodiment of the first, second, third, fourth or fifth aspect of the invention. The panels are rectangular, either square or oblong. The panels comprise a first pair of opposite edges—preferably on the long sides of the panel; namely a first edge and a second edge. The first edge comprises a first male coupling part. The second edge comprises a first female coupling part. The first male coupling part and the first female coupling part are configured such that a second such panel can be mutually coupled at its first edge to the second edge of a first such panel in a plane—preferably by means of an angling movement of the second such panel with respect to the first such panel—preferably wherein a locking of the thus coupled panels is obtained both in the direction in the plane of the panels and perpendicular to the thus coupled edges as well as in the direction perpendicular to the surface of the thus coupled panels. The panels comprise a second pair of opposite edges; namely a third edge and a fourth edge. The third edge comprises a second male coupling part. The fourth edge comprises a second female coupling part. The second male coupling part and the second female coupling part are configured such that a third such panel can be mutually coupled at its third edge to the fourth edge of a fourth such panel in a plane by means of a movement parallel to the plane of the panels of the third such panel with respect to the fourth such panel; wherein this movement parallel to the plane of the panels brings about a snap effect; preferably wherein a locking of the thus coupled panels is obtained both in the direction in the plane of the panels and perpendicular to the thus coupled edges as well as in the direction perpendicular to the surface of the thus coupled panels. The method comprises the following steps:

coupling of a second such panel at its first edge, preferably by means of an angling movement, to the second edge of a first such panel that has already been installed in the wall or ceiling covering; wherein a distance is formed between the third edge of the second such panel and the fourth edge of a third such panel that has already been installed in the wall or ceiling covering; or wherein a distance is formed between the fourth edge of the second such panel and the third edge of a third such panel that has already been installed in the wall or ceiling covering;

placement of an attachment element, wherein this attachment element comprises a male element—preferably a tongue—that is placed in the first female coupling part of the second such panel and in the first female coupling part of the third such panel, preferably by means of an angling movement or by means of sliding parallel to the plane of the second such panel. Optionally, this attachment element comprises a component that engages behind the second such panel and/or behind the third such panel—preferably wherein the component is movable—for example pivotable or slideable—in the attachment element in order to realize this engagement;

sliding of the second such panel in the direction parallel to its first pair of opposite edges toward the third such panel, wherein a coupling—preferably with a locking—is formed—preferably with a snap movement—of the fourth edge of the second such panel to the third edge of the third such panel; or of the third edge of the second such panel to the fourth edge of the third such panel; and removal of the attachment element.

An advantage of this aspect of the invention is that the first pair of opposite edges of the various panels can be perfectly aligned, which makes it possible to install an extremely high-quality covering in a simple manner—even by only one installer.

In a preferred embodiment of the twelfth aspect of the invention, the second edge of the first such panel is, by means of one or more fastening clips, fastened to the substructure before the second such panel at its first edge is coupled to the second edge of the first such panel. In this manner, these one or more fastening clips are fully hidden behind the front edge of the coupled panels of the wall or ceiling covering.

In a preferred embodiment of the twelfth aspect of the invention, a second attachment element is used. This second attachment element comprises coupling parts such that it can be temporarily coupled to the third edge; or this second attachment element comprises coupling parts such that it can be temporarily coupled to the fourth edge of the second such panel. This preferred embodiment of the method comprises the following steps:

coupling of this second attachment element by means of its coupling parts to the third or fourth edge of the second such panel, more specifically on the side of the edge where the force is to be exerted for the sliding of the second such panel in the direction parallel to its first edges;

exerting a pressing force—for example by striking with a hammer—on the thus coupled second attachment element in the direction parallel to the first pair of opposite edges of the second such panel for the sliding of the second such panel in the direction parallel to its first pair of opposite edges toward the third such panel, wherein a coupling—preferably with a locking—is formed—preferably with a snap movement—of the fourth edge of the second such panel to the third edge of the third such panel; or of the third edge of the second such panel to the fourth edge of the third such panel; and removal of the second attachment element.

The thirteenth aspect of the invention is an attachment element for the installation of panels, preferably of wall or ceiling panels. These panels comprise on one of their edges a first female coupling part; these panels are preferably panels in accordance with the first, second, third, fourth or fifth aspect of the invention. The first female coupling part comprises a first groove, wherein the first groove is delimited by a first front lip and a first rear lip. Preferably, this first female coupling part comprises a first locking element. Preferably, the first rear lip extends in a distal direction beyond the open or free end of the first front lip. A first edge of the attachment element comprises a first male coupling part. The first male coupling part comprises a first tongue. Preferably, the first male coupling part of the attachment element comprises first locking parts. The first male coupling part is configured such that the attachment element, by means of its first male coupling part, can be coupled to the first female coupling part of the panel by means of a tongue and groove connection. Preferably, the first male coupling part of the attachment element comprises first locking parts for interaction with first locking parts of the first female coupling part of the panel, such that a locking can be formed between the attachment element and the panel in the direction perpendicular to the panel and in the direction parallel to the panel and perpendicular to the edge of the panel that comprises the first female coupling part. Preferably, this attachment element comprises a component that can engage behind the panel—preferably wherein the component is movable, for example pivotable or slideable—in the attachment element in order to realize this engagement.

Preferably, the first male coupling part of the attachment element comprises a tongue, wherein this first male coupling part comprises a first locking part on the rear side of this tongue.

Preferably, the attachment element is produced from plastic, preferably by extrusion or injection molding. Optionally, the first coupling part is formed by mechanical processing—for example milling Such embodiments are advantageous in that this attachment element can be used repeatedly, wherein it can be coupled to a panel and again decoupled, without this damaging the functionality of the attachment element. Such an attachment element of MDF or HDF, for example, can be used less frequently.

More preferably, the plastic of the attachment element is substantially free of fillers.

Preferably, the attachment element is substantially produced from a thermoplastic resin, preferably polyamide—and more preferably from polyamide 6, or polyamide 6,6—or from polyester, or from polypropylene or from polyethylene.

Preferably, the length of the attachment element is less than 25 cm, more preferably less than 20 cm, more preferably less than 10 cm, even more preferably less than 7 cm. The length of the attachment element is measured on and parallel to the first edge of the attachment element. Such attachment elements have the advantage of being compact and functional. Excessively long attachment elements have the drawback that too much force has to be exerted in the coupling of the panels to the second pair of opposite edges.

Preferably, the width of the attachment element—measured in the direction perpendicular to the first edge of the attachment element—is less than 15 cm, more preferably less than 10 cm, even more preferably less than 7 cm. This ensures compact attachment elements that nevertheless have the necessary functionality. In a preferred embodiment of the method of the twelfth aspect of the invention, an attachment element is used in accordance with any embodiment of the thirteenth aspect of the invention.

In preferred embodiments of the tenth and/or eleventh aspect of the invention, the kit comprises an attachment element in accordance with any embodiment of the twelfth aspect of the invention.

BRIEF DESCRIPTION OF THE DRAWINGS

In order to better illustrate the features of the invention, in the following, as examples that by no means limit the invention, several preferred embodiments are described, with reference to the attached drawings, wherein.

DETAILED DESCRIPTION OF VARIOUS EMBODIMENTS

In the figures, identical reference numbers refer to the same element.

Figure 1:
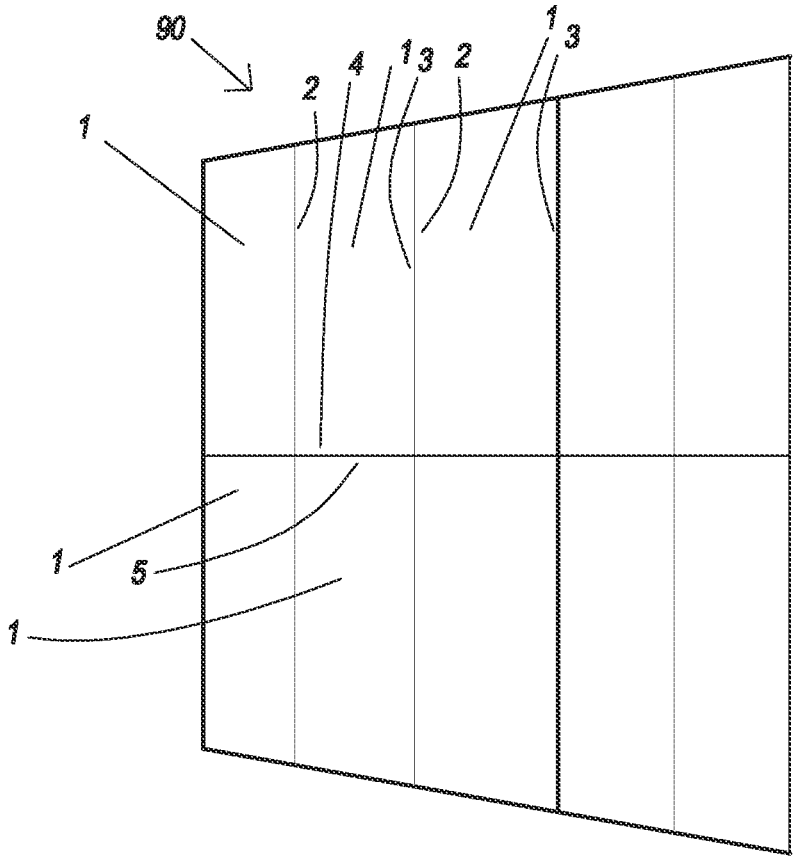
FIG. 1 shows an example of a wall or ceiling covering in accordance with aspects of the invention.

FIG. 1 shows an example of a wall or ceiling covering (90) in accordance with aspects of the invention. The covering comprises a plurality of wall or ceiling panels (1), for example such as described in aspects of the invention. The covering comprises a substructure (not visible in FIG. 1 as it is covered by the panels). The substructure comprises, for example, parallel laths to which the panels are fastened by means of a number of fastening clips (not visible in FIG. 1 as they are covered by the panels).

The panels of the covering are rectangular, and in the example of FIG. 1, oblong. However, square panels are also possible according to the invention. The panels (1) comprise a first pair of opposite edges (2, 3); namely a first edge (2) and a second edge (3). In the example, the first pair of opposite edges is provided along the long edges of the panels. As will be clarified in further figures, the first edge (2) comprises a first male coupling part; and the second edge (3) comprises a first female coupling part. The first male coupling part and the first female coupling part are configured such that two of such panels (1), by means of their first male and first female coupling parts, can be coupled to each other in a plane and a coupled state can thus be realized between the panels (1).

The panels comprise a second pair of opposite edges (4, 5); namely a third edge (4) and a fourth edge (5). As will be illustrated in further figures, the third edge (4) comprises a second male coupling part; and the fourth edge (5) comprises a second female coupling part. The second male coupling part and the second female coupling part are configured such that two of such panels (1), by means of their second male and second female coupling parts, can be coupled to each other in a plane and a coupled state can thus be realized between the panels (1). No fastening clips are used along the second pair of opposite edges (4, 5).

After installation of the panels, the panels were painted. In this process, no pre-processing was necessary on the stop surfaces of the installed panels.

Figure 2:
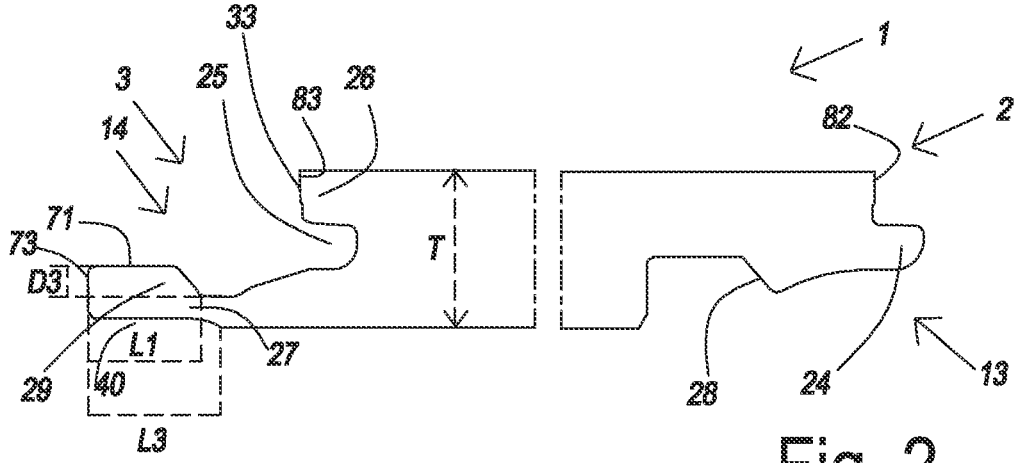
FIG. 2 shows a schematic cross-section perpendicular to the first pair of opposite edges of a wall or ceiling panel in accordance with aspects of the invention.
Figure 3:
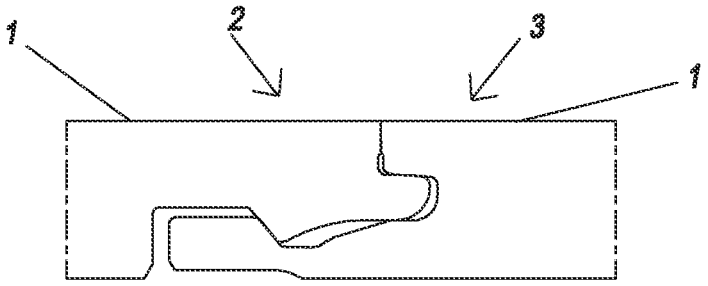
FIG. 3 shows a schematic cross-section perpendicular to the first pair of opposite edges of two wall or ceiling panels according to FIG. 2 coupled to each other at their first pair of opposite edges.
Figure 4:
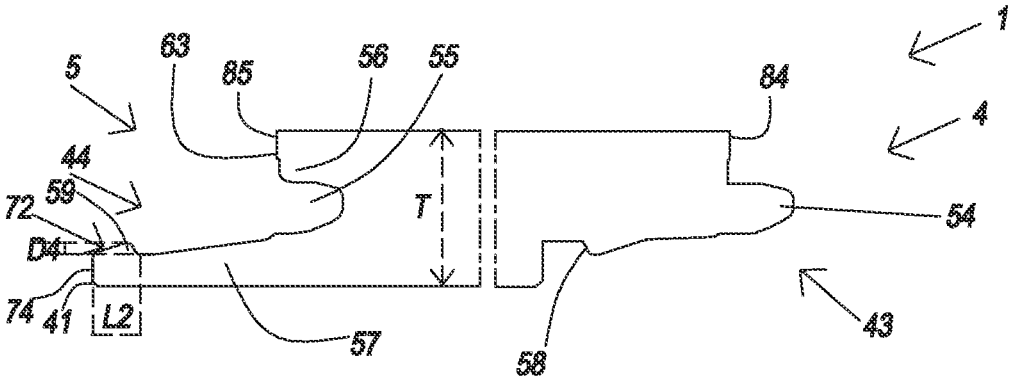
FIG. 4 shows a schematic cross-section perpendicular to the second pair of opposite edges of a wall or ceiling panel of the panel illustrated in FIG. 2.
Figure 5:
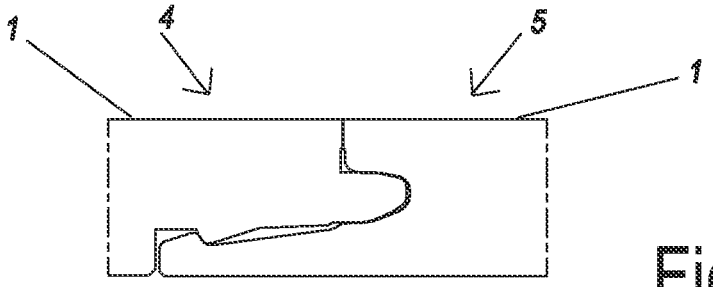
FIG. 5 shows a schematic cross-section perpendicular to the second pair of opposite edges of two wall or ceiling panels of the panels according to FIGS. 2, 3 and 4 coupled at their second pair of opposite edges.

FIG. 2 shows a schematic cross-section perpendicular to the first pair of opposite edges (2, 3) of a wall or ceiling panel (1) used in the wall or ceiling covering shown in FIG. 1. FIG. 3 shows a schematic cross-section perpendicular to the first pair of opposite edges (2, 3) of two such wall or ceiling panels (1) (i.e. according to FIG. 2) coupled to each other at their first pair of opposite edges. FIG. 4 shows a schematic cross-section perpendicular to the second pair of opposite edges (4, 5) of the wall or ceiling panel (1) used in the wall or ceiling covering of FIG. 1. FIG. 5 shows a schematic cross-section perpendicular to the second pair of opposite edges (4, 5) of two such wall or ceiling panels (1) (i.e. according to FIG. 3) coupled at their second pair of opposite edges.

The first edge (2) comprises a first male coupling part (13). The second edge (3) comprises a first female coupling part (14). The first male coupling part (13) and the first female coupling part (14) are configured such that two of such panels (1), by means of their first male and first female coupling parts (13, 14), can be coupled to each other in a plane and a coupled state can thus be realized between the panels (1) (this coupled state is shown in FIG. 3). The first male coupling part (13) comprises a first tongue (24). The first female coupling part (14) comprises a first groove (25), wherein the first groove (25) is delimited by a first front lip (26) and a first rear lip (27). In the example, the first rear lip (27) extends in a distal direction beyond the open or free end (33) of the first front lip (26). The first tongue (24) and the first groove (25) form in the coupled state a tongue and groove connection that realizes a mechanical locking between the panels (1) in the direction perpendicular to the plane of the panels (1). The first male coupling part (13) and the first female coupling part (14) each comprise a first locking part (28, 29). These first locking parts (28, 29) realize in the coupled state a mechanical locking between the panels (1) in the direction in the plane of the panels (1) and perpendicular to the first pair of opposite edges (2, 3). The first locking part (28) of the first male coupling part (13) is provided on the rear side of the first tongue (24), while the first locking part (29) of the first female coupling part (14) is provided on the front side of the first rear lip (27).

The panel (1) —see FIG. 4—comprises a second pair of opposite edges (4, 5); namely a third edge (4) and a fourth edge (5). The third edge (4) comprises a second male coupling part (43). The fourth edge (5) comprises a second female coupling part (44). The second male coupling part (43) and the second female coupling part (44) are configured such that two such panels (1), by means of their second male and second female coupling parts (43, 44), can be coupled to each other in a plane and a coupled state can thus be realized between the panels (1). The second male coupling part (43) comprises a second tongue (54). The second female coupling part (44) comprises a second groove (55), wherein the second groove (55) is delimited by a second front lip (56) and a second rear lip (57). In the example, the second rear lip (57) extends in a distal direction beyond the open or free end (63) of the second front lip (56). The second tongue (54) and the second groove (55) form in the coupled state (as illustrated in FIG. 5) a tongue and groove connection that realizes a mechanical locking between the panels (1) in the direction perpendicular to the plane of the panels (1). The second male coupling part (43) and the second female coupling part (44) each comprise a second locking part (58, 59). These second locking parts (58, 59) realize in the coupled state a mechanical locking between the panels (1) in the direction in the plane of the panels (1) and perpendicular to the second pair of opposite edges (4, 5). The second locking part (58) of the second male coupling part (43) is provided on the rear side of the second tongue (54). The second locking part (59) of the second female coupling part (44) is provided on the front side of the second rear lip (57).

The length (L1) of the first locking part (29) of the first rear lip (27) measured in the direction perpendicular to the second edge (3) and in the plane parallel to the front edge of the panel (1) is greater than the length (L2) of the second locking part (59) of the second rear lip (57) measured in the direction perpendicular to the fourth edge (5) and in the plane parallel to the front edge of the panel (1).

The distance (D3) measured perpendicular to the plane of the panel (1) between the front point of the first locking part (29) of the first female coupling part (14) and the rear point on the front edge of the first rear lip (27) is greater than the distance (D4) measured perpendicular to the plane of the panel (1) between the front point of the second locking part (59) of the second female coupling part (44) and the rear point on the front edge of the second rear lip (57).

The front edge (71) of the first locking part (29) of the first female coupling part (14) is parallel to the surface of the panel over at least 75% of its length as measured in the direction in the plane of the panel and perpendicular to the second edge (3) of the panel. The front edge (72) of the second locking part (59) of the second female coupling part (44) is curved over at least half of its length—and preferably over its entire length—as measured in the direction in the plane of the panel and perpendicular to the fourth edge of the panel (5).

The first rear lip (27) is provided on its rear side with a first recess (40). In the example shown, the second rear lip (57) comprises on the rear side a limited recess (41) that extends from the open or free end (74) of the second rear lip (57) in the direction perpendicular to the fourth edge (5) and in the plane parallel to the surface of the panel over a shorter distance than the distance over which the first recess (41) extends from the open or free end (73) of the first rear lip (27) in the direction perpendicular to the second edge (3) and in the plane parallel to the surface of the panel (1). This recess (41) on the second rear lip (27) is more a rounding-off of the second rear lip than a functional recess.

The first recess (40) runs in the direction parallel to the plane of the panel and perpendicular to the edge of the panel that comprises the first rear lip over at least a part of the recess parallel to the surface of the panel. The front edge of the first locking part (29) of the first female coupling part is parallel to the surface of the panel over at least a part of the length of the first recess (40) where this is parallel to the surface of the panel.

The first recess (40) is parallel to the plane of the front side of the panel over at least half of its length (L3) as measured in the plane of the panel and perpendicular to the second edge (3) of the panel.

The first recess (40) extends from the open or free end (73) of the first rear lip (27) to past the first locking part (29) of the first female coupling part (14).

The first edge (2) comprises a first stop surface (82) perpendicular to the plane of the panel; wherein this first stop surface extends up to the front edge of the panel. The second edge (3) comprises a second stop surface (83) perpendicular to the plane of the panel; wherein this second stop surface extends up to the front edge of the panel. In the coupled state of two such panels at their first pair of opposite edges (2, 3), the first stop surface (82) lies against the second stop surface (83). The third edge (4) comprises a third stop surface (84) perpendicular to the plane of the panel; wherein this third stop surface extends up to the front edge of the panel. The fourth edge (5) comprises a fourth stop surface (85) perpendicular to the plane of the panel; wherein this fourth stop surface extends up to the front edge of the panel. In the coupled state of two such panels at their second pair of opposite edges (4, 5), the third stop surface (84) lies against the fourth stop surface (85).

The rear edge of the first rear lip (27) lies in the part thereof that extends further than the first front lip (25) partially in the plane of the rear edge of the panel.

The first rear lip (27) is configured such that a part of the first rear lip (27) can bend backwards, even if the panel (1) or the first rear lip (27) is attached to a flat substructure.

In the coupled state of two panels at their first pair of opposite edges (2, 3), the active locking zone defined by the first locking parts (28, 29) is situated completely beyond the open or free end of the first front lip (26). The part of the first rear lip (27) that extends in a distal direction beyond the open or free end (33) of the first front lip (26) is longer than the thickness (T) of the panel (1).

The first male coupling part (13) and the first female coupling part (14) are configured such that in the coupled state, they fit into each other with pretension. The first male coupling part (13) and the first female coupling part (14) are made completely from the material of the panel, and in one part therewith.

In the coupled state of two such panels at their second pair of opposite edges (4, 5), the active locking zone defined by the second locking parts (58, 59) is situated completely beyond the open or free end of the second front lip (56). The part of the second rear lip (57) that extends in a distal direction beyond the open or free end of the first front lip (56) is longer than the thickness (T) of the panel. The second male coupling part (43) and the second female coupling part (44) are configured such that in the coupled state, they fit into each other with pretension. The second male coupling part (43) and the second female coupling part (44) are made completely from the material of the panel, and in one part therewith.

The panels (1) used in the covering shown in FIG. 1 and clarified in FIGS. 2, 3, 4 and 5 can be coupled to each other at their first pair of opposite edges (2, 3) by means of an angling movement with a snap effect. At their second pair of opposite edges, these panels can be coupled to each other by means of horizontal sliding of the one panel into the other panel, wherein a snap effect occurs.

FIGS. 6, 7, 8, 9 and 13 schematically illustrate—in cross-section perpendicular to the first pair of opposite edges (2, 3) —the installation of wall or ceiling panels (1) in accordance with aspects of the invention. The second edge (3) of a first wall or ceiling panel is fastened to a substructure (7) by means of a fastening clip (8). The substructure can for example comprise a number of parallel laths that are fastened to the wall or to the ceiling. The fastening clips (8) are then fastened to these laths. Preferably, such laths are oriented perpendicular to the first pair of opposite edges (2, 3).

The opening (46) of the fastening clip (8) is slid over a part of the first locking part (29) of the first female coupling part (14) of the first panel (1). A second such panel is coupled by means of its first male coupling part (13) to the first female coupling part (14) of this first such panel.

Figure 6:
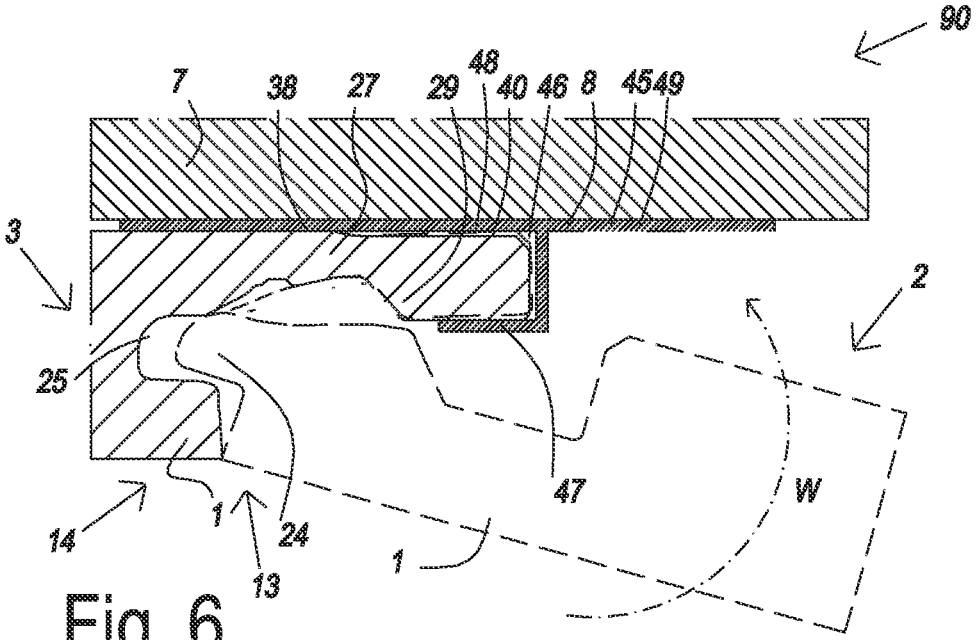
FIG. 6 shows a schematic view—in cross-section perpendicular to the first pair of opposite edges—of the installation of wall or ceiling panels in accordance with aspects of the invention.

FIG. 6 illustrates that a subsequent panel (1) can be coupled by means of an angling movement at its second edge (2) to the first edge (1) of the already installed panel.

Figure 7:
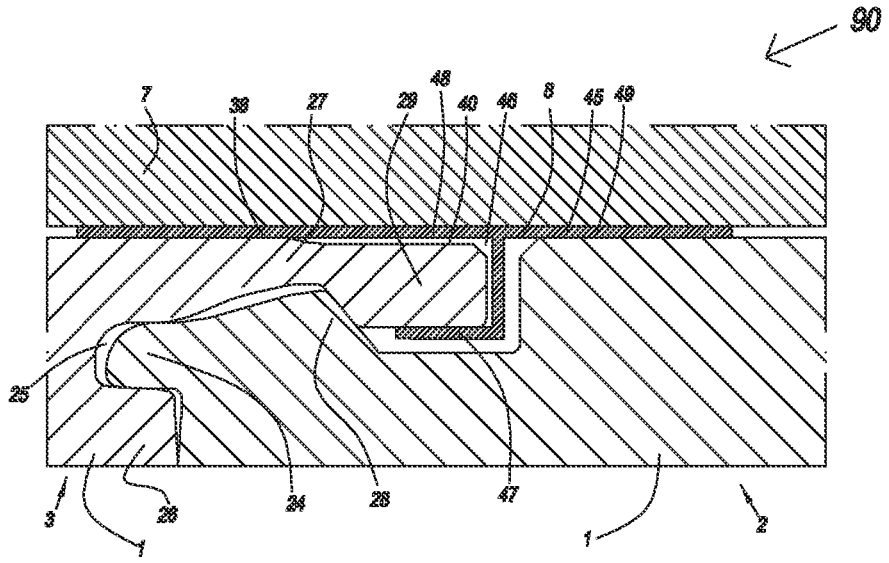
FIGS. 7, 8 and 9 show schematic views—in cross-section perpendicular to the first pair of opposite edges—of a ceiling covering in accordance with aspects of the invention.

In the example of FIGS. 6 and 7, the fastening clip (8) comprises a base arm (45), a front arm (47), and a rear arm (48). The opening (46) is situated between the front arm (47) and the rear arm (48). The rear arm (48) lies over at least a part thereof in line with at least a part of the base arm (45). The base arm (45), by means of one or more fastening elements—for example one or more screws, one or more nails, one or more staples, or an adhesive joint—is fastened to the substructure.

Figure 8:
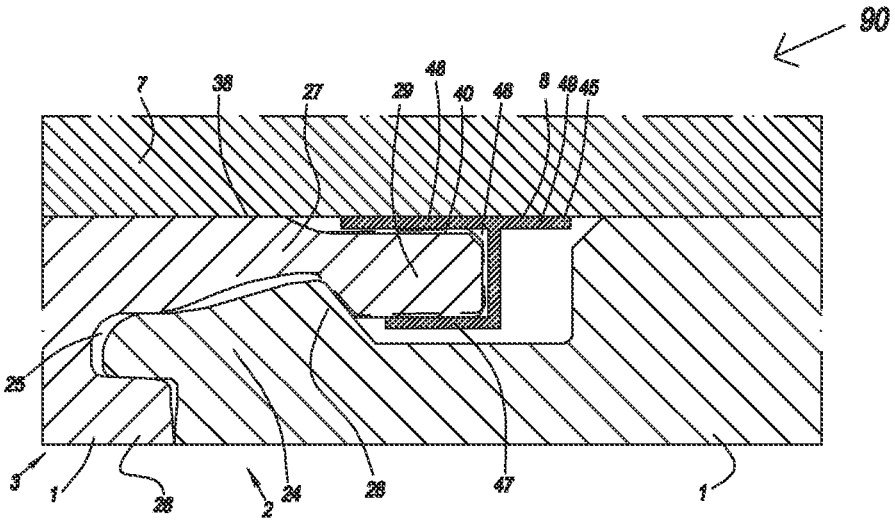

FIG. 8 illustrates a fastening clip—that is otherwise highly similar to that illustrated in FIG. 7—wherein the rear arm (48) does not come into contact with the first such panel (1). In the fastening clip of FIG. 8, the base arm (45) does not come into contact with panels of the wall or ceiling covering.

Figure 9:
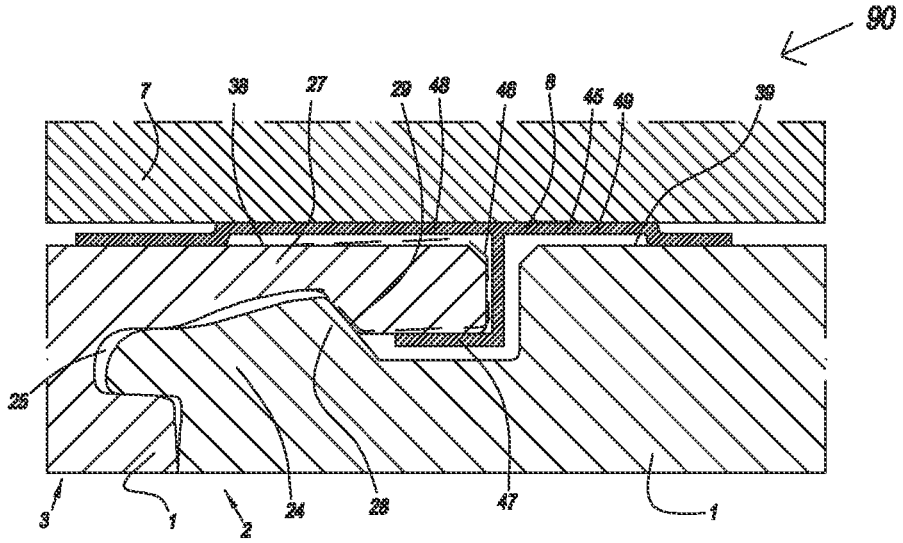

FIG. 9 shows a fastening clip (8) wherein the rear arm (48) is configured to keep the rear side (38) of the first such panel over its entire surface at a distance from the substructure that is greater than the thickness of the rear arm (48). For this purpose, the rear arm (48) comprises a step-shaped component (49). The base arm (45) of the fastening clip (8) of FIG. 9 is configured to keep the rear side (39) of the second such panel over its entire surface at a distance from the substructure that is greater than the thickness of the base arm (45); for this purpose, the base arm (45) comprises a step-shaped component (49).

Figure 10:
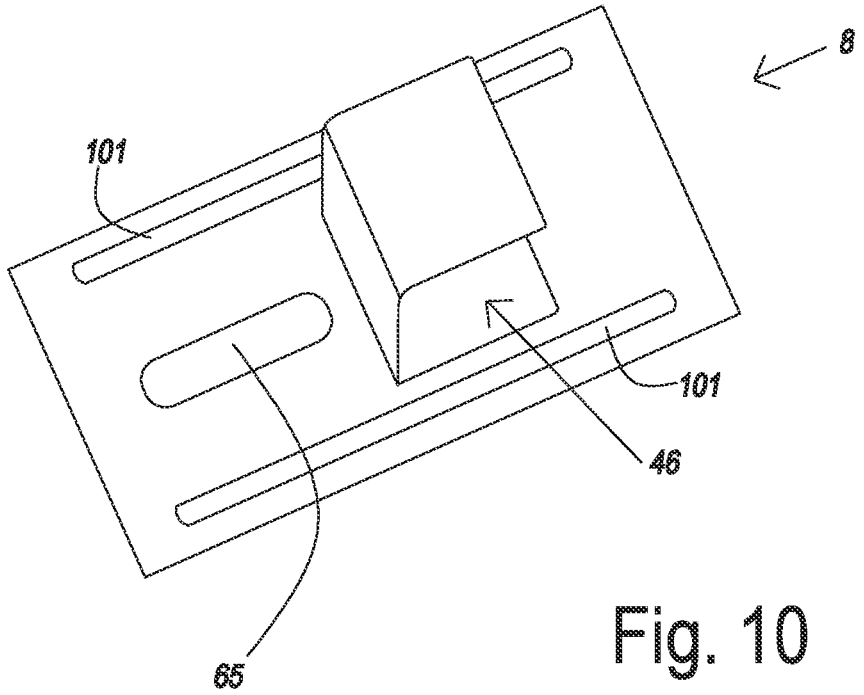
FIG. 10 shows a fastening clip with a slotted hole such as can be used in the invention.

Preferably, the fastening clips are fastened to the substructure such that the fastening clips can slide with respect to the substructure in the direction perpendicular to the first pair of opposite edges and in the plane of the panel on expansion of the panel in the direction perpendicular to the first pair of opposite edges and parallel to the plane of the panel. This is for example possible by using a fastening clip with a slotted hole such as shown in FIG. 10. Such clips with a slotted hole can further be configured such as the fastening clips shown in FIGS. 6, 7, 8 and 9.

FIG. 10 shows a fastening clip (8) with a slotted hole (65) such as can be used in the invention. The fastening clip comprises an opening (46). The fastening clip comprises pressed-in reinforcing ribs (101). The slotted hole (65) is positioned such that on use of this fastening clip, it will be perpendicular to the second edge of the panel. The fastening clip can be fastened with a screw (not shown in the figures) —through the slotted hole—to the substructure. The fastening clip (8) can slide with respect to the screw and with respect to the substructure on expansion of the panel in the direction perpendicular to the second edge (3) and parallel to the plane of the panel.

Figure 11:
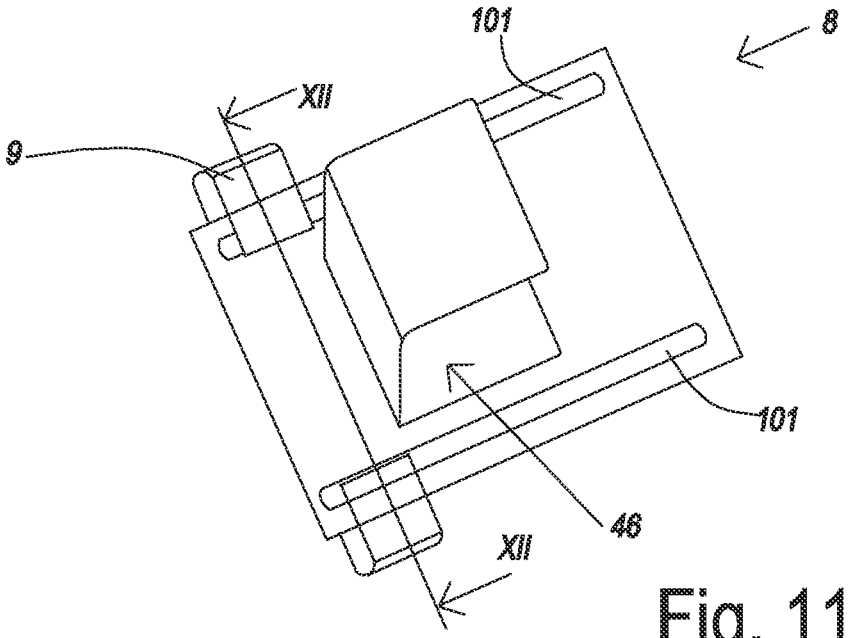
FIG. 11 shows an example of a fastening clip that is slideable into a second clip, in accordance with aspects of the invention, FIG. 12—in a view different from that of FIG. 11—shows an example of a fastening clip that is slideable into a second clip, in accordance with aspects of the invention.
Figure 12:
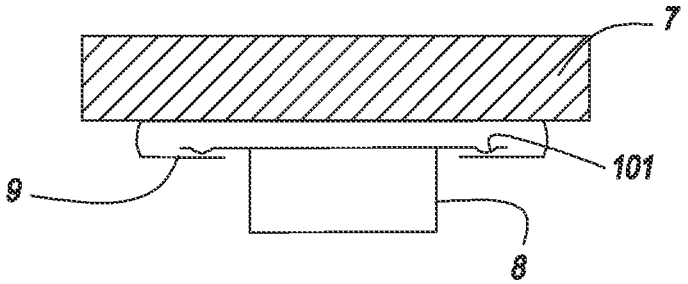
Figure 13:
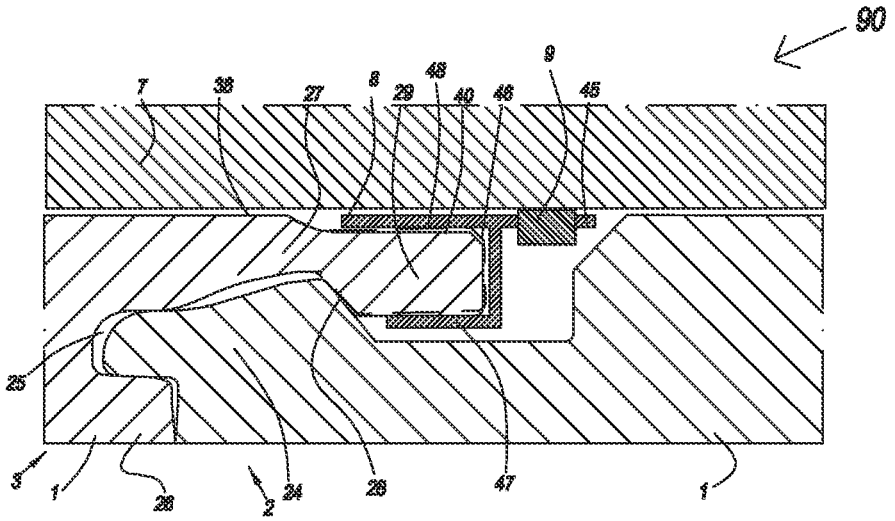
FIG. 13 shows a ceiling covering in cross-section perpendicular to the first pair of opposite edges with two coupled panels fastened with a clip such as in FIGS. 11 and 12.

FIGS. 11, 12, 13 illustrate an embodiment of a wall or ceiling covering wherein the fastening clip (8) is kept suspended in a second clip (9). This second clip (9) is fastened to the substructure (7) —preferably in a non-slideable manner, e.g. by means of one or more fastening means, e.g. one or more screws. The fastening clip (8) can slide with respect to the second clip (9) and with respect to the substructure (7) on expansion of the panel in the direction perpendicular to the second edge (3) and parallel to the plane of the panel.

FIG. 11 shows such a fastening clip (8), with its opening (46), slideable into a second clip (9), in accordance with aspects of the invention. This fastening clip (8) comprises two pressed-in reinforcing ribs (101). FIG. 12 shows this fastening clip (8), which is slideable into a second clip (9) according to section XII-XII of FIG. 11 and fastened to a lath (7) that in turn is fastened to a ceiling. FIG. 13 shows, in cross-section perpendicular to the first pair of opposite edges (2, 3), a ceiling covering with two coupled panels fastened with a fastening clip (8) and second clip (9) such as in FIGS. 11 and 12. The fastening clip (8) is slid into the second clip (9) after fastening of the second clip (9) to the substructure (7).

Figure 14:
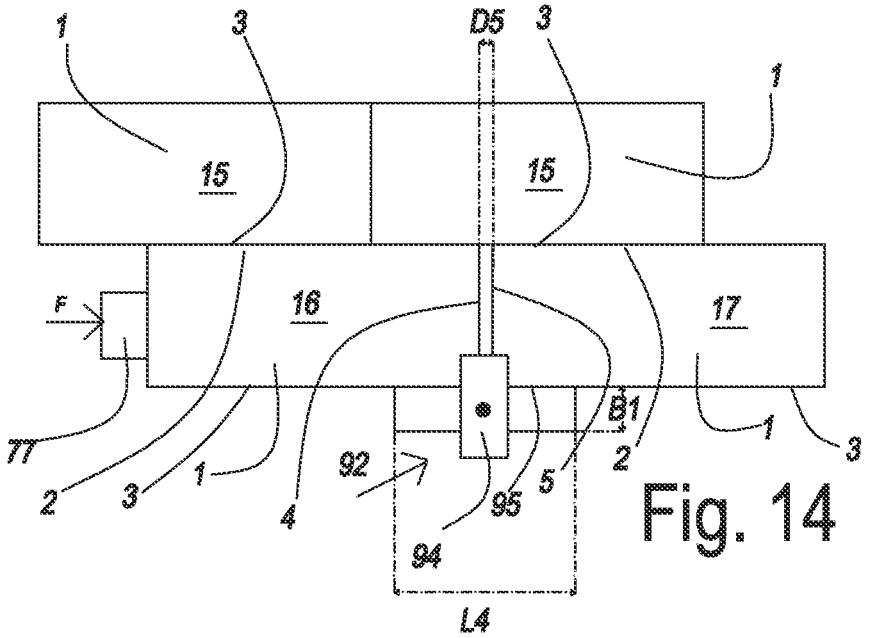
FIG. 14 illustrates the method in accordance with an aspect of the invention for the installation of a wall or ceiling covering.
Figure 15:
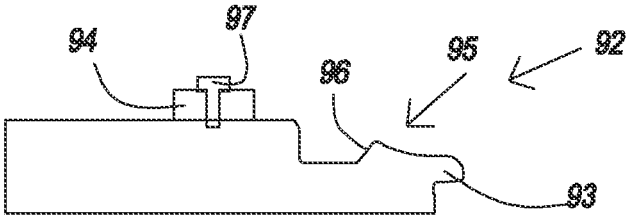
FIG. 15 shows an attachment element that can be used in the method according to the invention, FIG. 16, in cross-section perpendicular to the first pair of opposite edges of a wall or ceiling panel in accordance with aspects of the invention, illustrates the use according to the method of the invention of the attachment element of FIG. 15, FIGS. 17, 18 and 19 show configurations of the second pair of opposite edges in accordance with embodiments of the invention.
Figure 16:
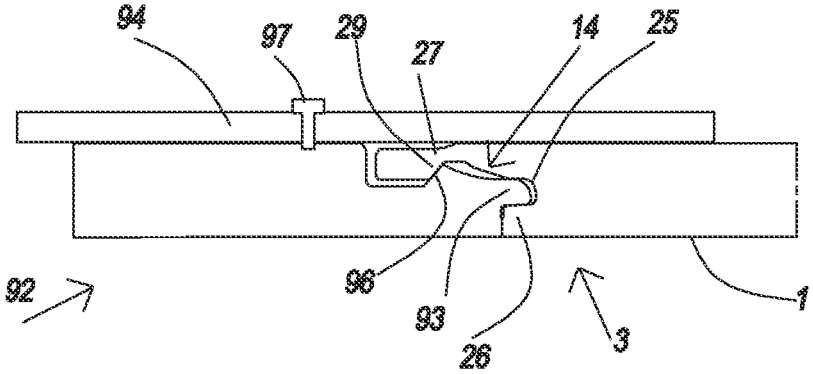

FIG. 14 illustrates the method in accordance with the twelfth aspect of the invention for the installation of a wall or ceiling covering. FIG. 15 shows an attachment element (92) —in accordance with the thirteenth aspect of the invention—that can be used in the method in accordance with the twelfth aspect of the invention. FIG. 16 illustrates, in cross-section perpendicular to the first pair of opposite edges (2, 3) of a wall or ceiling panel (1), the use of the attachment element (92) in accordance with the thirteenth aspect of the invention in the method of the twelfth aspect of the invention. FIGS. 14, 15 and 16 are explained together in the following.

FIG. 14 schematically illustrates an example of a method—in accordance with the twelfth aspect—for the installation of a wall or ceiling covering. This wall or ceiling covering comprises a plurality of panels (1) —preferably wall or ceiling panels such as discussed in FIGS. 2-6. The panels are rectangular, either square or oblong. The panels (1) have a first pair of opposite edges (2, 3) —preferably on the long sides of the panel; namely a first edge (2) and a second edge (3). The first edge comprises (2) a first male coupling part (not visible in FIG. 14). The second edge (3) comprises a first female coupling part (not visible in FIG. 14). The first male coupling part and the first female coupling part are configured such that a second such panel can be mutually coupled at its first edge (2) to the second edge (3) of a first such panel in a plane, by means of an angling movement of the first such panel with respect to the second such panel; wherein a locking of the thus coupled panels is obtained both in the direction in the plane of the panels and perpendicular to the thus coupled edges as well as in the direction perpendicular to the surface of the thus coupled panels. The panels comprise a second pair of opposite edges (4, 5); namely a third edge (4) and a fourth edge (5). The third edge (4) comprises a second male coupling part (not shown in FIG. 14). The fourth edge (5) comprises a second female coupling part (not shown in FIG. 14). The second male coupling part and the second female coupling part are configured such that a third such panel can be mutually coupled at its third edge (4) to the fourth edge (5) of a fourth such panel in a plane by means of a movement parallel to the plane of the panels of the third such panel with respect to the fourth such panel; wherein this movement parallel to the plane of the panels brings about a snap effect; wherein a locking of the thus coupled panels is obtained both in the direction in the plane of the panels and perpendicular to the thus coupled edges as well as in the direction perpendicular to the surface of the thus coupled panels.

This method comprises the step of the coupling of a second such panel (16) at its first edge (2), by means of an angling movement, to the second edge (3) of two parallel first such panels (15) that have already been installed in the wall or ceiling covering. In this process, a distance (D5) is formed between the third edge (4) of the second such panel (16) and the fourth edge (5) of a third such panel (17) that has already been installed in the wall or ceiling covering.

The second edge (3) of the first such panels (15) is fastened by means of one or more fastening clips to the substructure (7) before the second such panel (16) is coupled at its first edge (2) to the second edge (3) of the first such panels (15). In this manner, these fastening clips are fully hidden behind the front edge of the coupled panels of the wall or ceiling covering.

The method comprises the step of the placement of an attachment element (92). This attachment element (92) and its action are illustrated in FIGS. 15 and 16. The attachment element (92) is coupled to the first female coupling part (14) of the second edge (3) of the second (16) and third (17) such panel. The first female coupling part (14) of the second edge (3) of the panel comprises a first groove (25), delimited by a first front lip (26) and a first rear lip (27). This first female coupling part comprises a first locking element (29). A first edge of the attachment element (92) comprises a first male coupling part (95), in the form of a first tongue (93). This tongue (93) comprises on its rear side a first locking part (96). The first male coupling part (95) of the attachment element (92) is configured such that the attachment element (92) can be coupled by means of its first male coupling part (95) to the first female coupling part (14) of the panel by means of a tongue and groove connection. The first locking part (96) of the attachment element interacts with the first locking part (29) of the first female coupling part (14) of the panel, such that a locking can be formed between the attachment element and the panel in the direction perpendicular to the panel and in the direction parallel to the panel and perpendicular to the edge of the panel that comprises the first female coupling part. The attachment element (92) comprises a component (94) that can engage behind the panel. This component is pivotable in the attachment element (92). FIG. 15 shows the section of the attachment element (92), in a position wherein the component (94) is oriented parallel to the longitudinal direction of the attachment element (92). In this configuration, the attachment element (92) can be coupled to a second edge (3) of a panel. After this coupling, the component (94) is pivoted such that it engages behind the coupled panel, as illustrated in FIG. 16 in a ceiling configuration. In this manner, the attachment element is temporarily fixed on these panels. The figures show an attachment element (92) that comprises a component (94) that can engage behind the panel; such components are optional for the invention. The attachment element (92) has a length (L4) —for example 6 cm—and a width (B1) —for example 4 cm.

In the method, the tongue (93) of the attachment element (92) is placed in the first female coupling part (14) of the first such panel (16) and in the first female coupling part (14) of the third such panel (17) by means of an angling movement or by means of sliding parallel to the plane of the second such panel. Component (94) is then brought into position such that it engages behind the second such panel (16) and behind the third such panel (17). In the example, the component (94) is pivotable with respect to a pivot point (97) of the attachment element (92).

The method further comprises the sliding of the second such panel (16) in the direction parallel to its first pair of opposite edges (2, 3) toward the third such panel (17), wherein a coupling—preferably with a locking—is formed—preferably with a snap movement—of the fourth edge (5) of the second such panel (16) to the third edge (4) of the third such panel (17).

In the example, an attachment element (77) is used in order to allow this sliding to take place more efficiently and easily. This second attachment element (77) comprises coupling parts such that they can be temporarily coupled to the third edge (4) of the second such panel (16). After this coupling of the second attachment element (77), a pressing force (F) is exerted by means of a hammer on the thus coupled second attachment element (77) in the direction parallel to the first pair of opposite edges (2, 3) of the second such panel.

The attachment element (92) and the second attachment element (77) are then removed.

Figure 17:
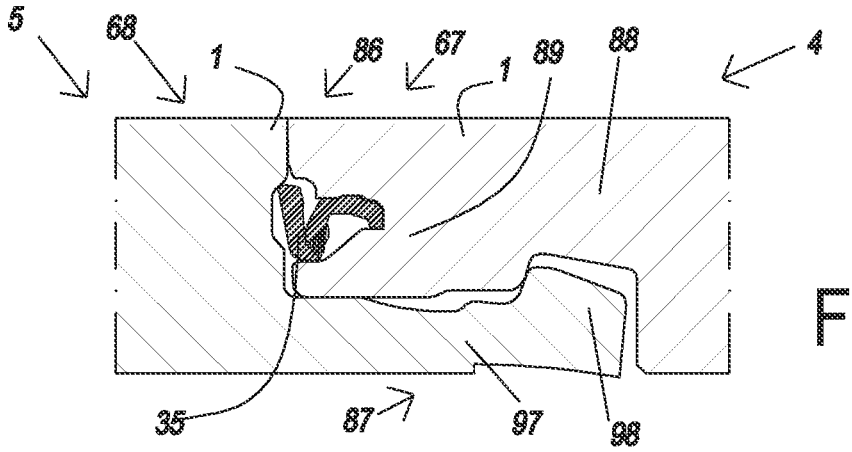
Figure 18:
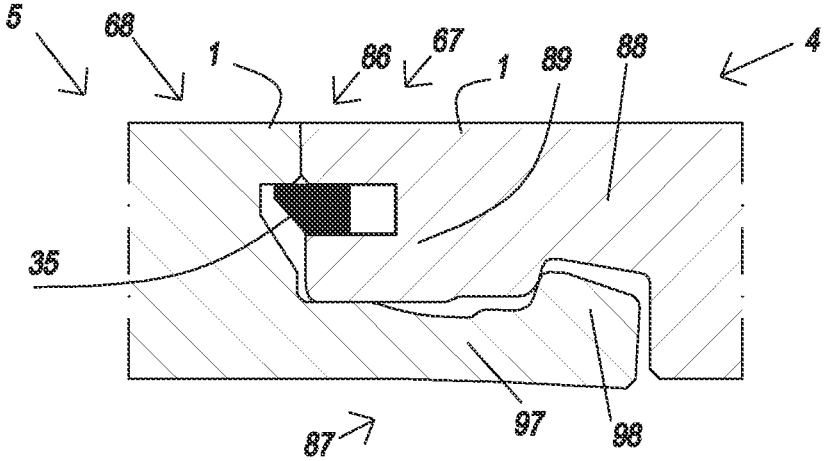
Figure 19:
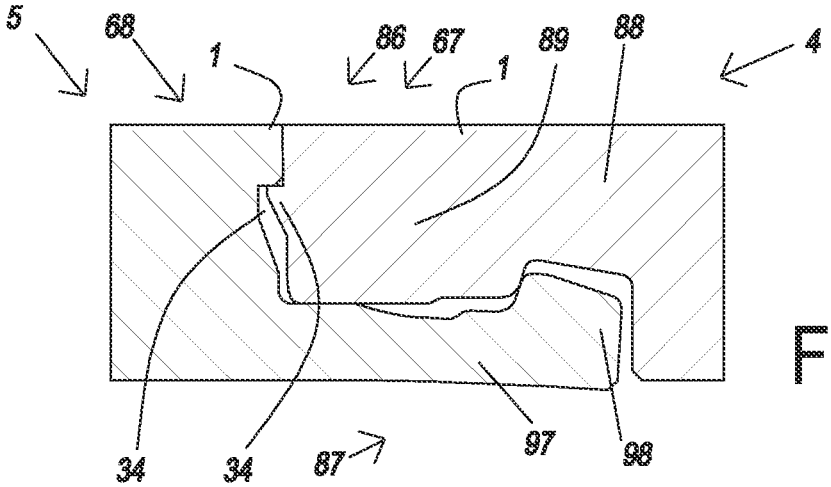

FIGS. 17, 18 and 19 show—in cross-section perpendicular to the second pair of opposite edges (4, 5) and in a coupled state on the second pair of opposite edges of two such panels (1) —configurations of the second pair of opposite edges in accordance with embodiments of wall or ceiling panels in accordance with aspects of invention. These panels comprise a second pair of opposite edges (4, 5); namely a third edge (4) and a fourth edge (5). The third edge (4) comprises a second male coupling part (67). The fourth edge (5) comprises a second female coupling part (68). The second male coupling part (67) and the second female coupling part (68) are configured such that two of such panels, by means of their second male and second female coupling parts, can be coupled to each other in a plane and a coupled state can thus be realized between the panels; by means of a mostly vertical—with respect to the plane of the thus coupled panels—coupling motion of the one panel with respect to the other panel. Here, a third such panel is coupled at its third edge to the fourth edge of the first such panel by means of their respective coupling parts at their third and fourth edges, wherein the thus coupled panels are locked to each other in the plane parallel to the surface of the panels and perpendicular to the second pair of opposite edges; and perpendicular to the surface of the coupled panels.

The second male coupling part (67) of the panel is configured as a hook-shaped component facing toward the rear side of the panel, referred to hereinafter as a locking hook (86). The second female coupling part (68) is configured as a hook-shaped component facing toward the front side of the panel, referred to hereinafter as a receiving hook (87). The hook-shaped components (86, 87) are produced mainly from the material of the core of the panels, and are mainly configured to form a single piece herewith. The locking hook (86) comprises a lip (88) that is provided with a locking component (89) extending toward the rear side of the panel. The receiving hook (87) comprises a lip (97) that is provided with a locking component (98) extending toward the front side of the panel. These locking parts work in conjunction in the coupled state such that they at least bring about the locking in the direction parallel to the surface of the panels and perpendicular to the second pair of opposite edges.

The second male coupling part and the second female coupling part comprise further locking parts (34, 35) for the locking in the direction perpendicular to the plane of the panel. In the examples of FIGS. 17 and 18, these further locking parts comprise an insert (35), wherein on the coupling of the panel at its third edge (4) to the fourth edge (5) of another such panel, a movement of or into the insert (35) brings about the locking in the direction perpendicular to the plane of the thus coupled panels. In the example of FIG. 19, these further locking parts (34) are formed by a protuberance and an undercut in the substrate of the panel, respectively.

The panels of FIGS. 17, 18 and 19 are configured at their second pair of opposite edges such that they can also be coupled at their second pair of opposite edges to one another through sliding parallel to the plane of the panels from the one panel toward the other panel; in order to allow coupling to take place in this manner, the lip (97) of the receiving hook (87) can be bent backward, wherein a coupling with pretension is realized at the second pair of opposite edges.

Figure 20:
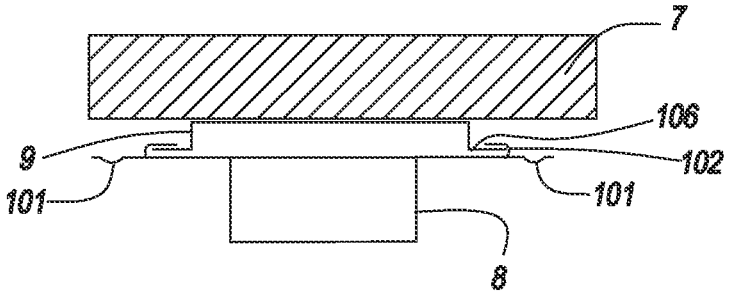
FIGS. 20 and 21 illustrate a draft of a fastening clip held suspended in a second clip.
Figure 21:
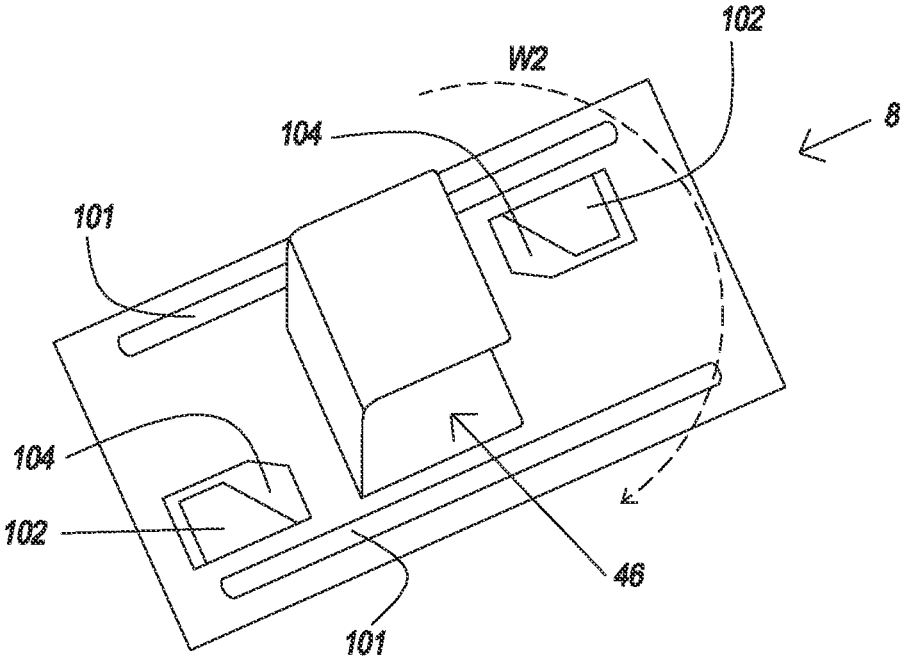

FIGS. 20 and 21 illustrate a draft of fastening clip (8) held suspended in a second clip (9). The fastening clip (8) is shown schematically in FIG. 21. The fastening clip (8) comprises an opening (46), two pressed-in reinforcing ribs (101), and two further openings (104). A hook (102) is provided under each of the further openings (104). FIG. 20 shows—in the same view as in FIG. 12—the fastening clip (8) held suspended in a second clip (9) that is fastened to the substructure (7). This second clip (9) is preferably a short length cut from a profile. The fastening clip (8) of FIG. 21, by means of a rotary motion in the direction W2 indicated in FIG. 21, can be fastened to the second clip (9). In this manner, each of the hooks (102) of the fastening clip (8) engages over a leg (106) of the second clip (9).

Figure 22:
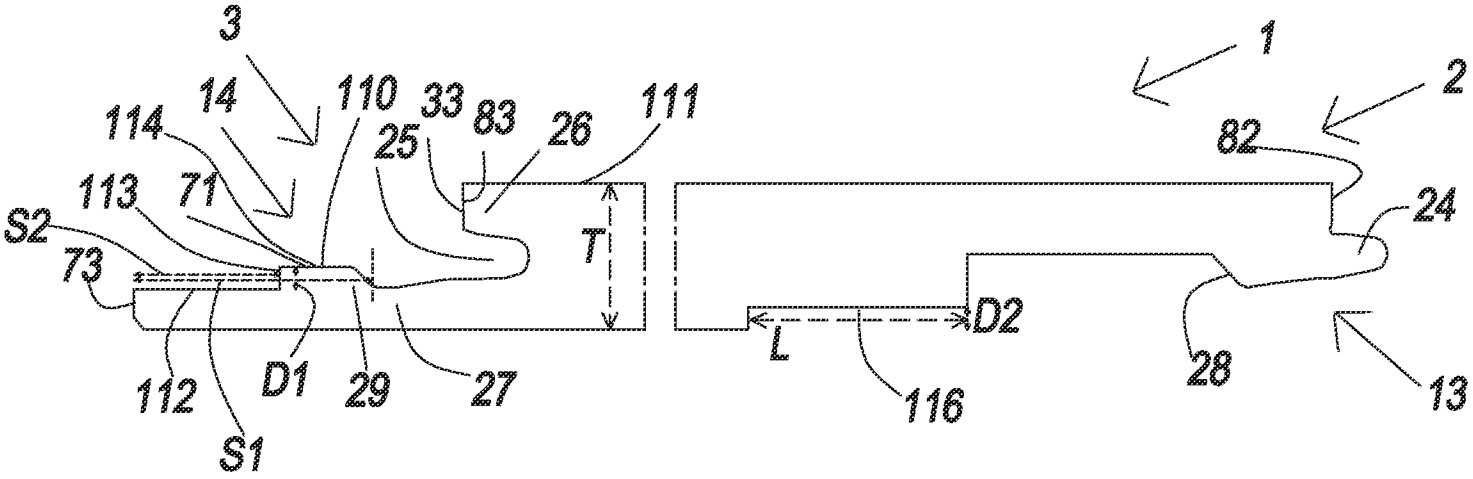
FIGS. 22 and 23 illustrate a wall or ceiling panel in accordance with aspects of the invention.
Figure 23:
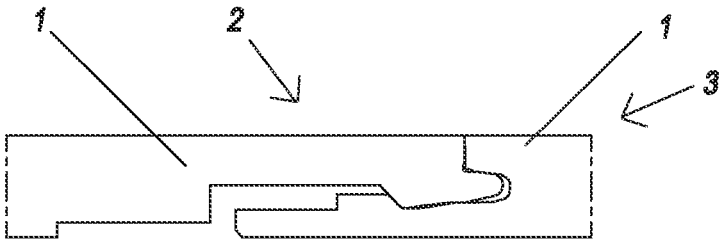

FIG. 22 schematically shows—in the same view as FIG. 2—a cross-section perpendicular to the first pair of opposite edges (2, 3) of a wall or ceiling panel (1) in accordance with aspects of the invention that can be used in a wall or ceiling covering, for example as shown in FIG. 1. FIG. 23 schematically shows—in the same view as in FIG. 3—a cross-section perpendicular to the first pair of opposite edges (2, 3) of two such wall or ceiling panels (1) (i.e. according to FIG. 22) coupled to each other at their first pair of opposite edges. The reference numbers have the same meaning as in the other figures. The wall or ceiling panel (1) of FIGS. 22 and 23 is rectangular, either square or oblong. The panel comprises a first pair of opposite edges (2, 3); namely a first edge (2) and a second edge (3). The first edge comprises a first male coupling part (13) and the second edge comprises a first female coupling part (14). The first male coupling part (13) and the first female coupling part (14) are configured such that two of such panels (1), by means of their first male and first female coupling parts (13, 14), can be coupled to each other in a plane and a coupled state can thus be realized between the panels (1) as shown in FIG. 23. The first male coupling part (13) comprises a first tongue (24) and the first female coupling part (14) comprises a first groove (25). The first groove (25) is delimited by a first front lip (26) and a first rear lip (27). The first rear lip (27) extends in a distal direction beyond the open or free end (33) of the first front lip (26). The first tongue (24) and the first groove (25), in the coupled state, form a tongue and groove connection that realizes a mechanical locking between the panels (1) in the direction perpendicular to the plane of the panels (1). The first male coupling part (13) and the first female coupling part (14) each comprise a first locking part (28, 29), which first locking parts (28, 29), in the coupled state, realize a mechanical locking between the panels (1) in the direction in the plane of the panels (1) and perpendicular to the first pair of opposite edges (2, 3). The first locking part (28) of the first male coupling part (13) is provided on the rear side of the first tongue (24). The first locking part (29) of the first female coupling part (14) is provided on the front side of the first rear lip (27). The first locking part (29) of the first female coupling part (14) comprises, distal to the location (110) of the first locking part (29) of the first female coupling part that is closest to the surface (111) of the panel, a zone (112) that is parallel to the surface (111) of the panel or that makes an angle of inclination of at most 5° with the surface of the panel. This zone (112) —with length S2—accounts for at least half—and preferably more than 60%—of the length S1 of the first locking part (29) of the first female coupling part (14) measured in the direction perpendicular to the second edge (3).

In the example shown in FIGS. 22 and 23, this entire zone (112), in the direction perpendicular to the plane of the panel, lies at least 0.3 mm—and preferably at least 0.4 mm, and more preferably at least 0.5 mm—lower (see dimension D1) than the location of the first locking part (29) of the first female coupling part (14) that is closest to the surface of the panel.

The first locking part (29) of the first female coupling part comprises, on the side facing the surface of the panel, a step (113), wherein the zone that is parallel to the surface of the panel or that makes an angle of inclination of at most 5° with the surface of the panel is distal to this step (113) and wherein the location of the first locking part (29) of the female coupling part that is closest to the surface of the panel lies proximal to the step (113).

The location (110) of the first locking part (29) of the first female coupling part (14) located closest to the surface (111) of the panel is situated in a section (114) of the first locking part (29) of the first female coupling part that is parallel to the surface (111) of the panel.

In the panel shown in FIGS. 22 and 23, the first edge (2) comprises, proximal to the first locking part (28) of the first male coupling part (13), a recess (116) —in the example shown, parallel to the surface (111) of the panel—wherein this recess (116), which is perpendicular with respect to the surface (111) of the panel, has a depth (D2) of at least 0.4 mm; wherein the length (L) of the recess in the direction perpendicular to the first edge (2) is at least 0.3 mm, and preferably at least 0.5 mm.

Figure 24:
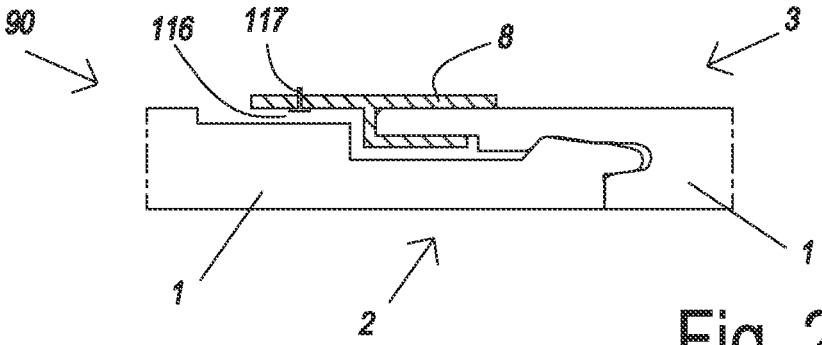
FIG. 24 shows a wall or ceiling covering in accordance with aspects of the invention.

FIG. 24 shows a wall or ceiling covering wherein panels according to FIGS. 22 and 23 are used, and wherein a clip (8) is used in order to fasten the panels to a base (not shown in FIG. 24). The reference numbers have the same meaning as in the other figures. The recess (116) provides space on the head of a screw or nail (117) by means of which the clip (8) can be fastened to the base. It is also possible to use other types of clips, for example the clips and the installation method shown in the other figures and/or discussed in this document.

The invention claimed is:

1. A wall or ceiling panel, wherein the panel is rectangular, either square or oblong, wherein the panel comprises a first pair of opposite edges including a first edge and a second edge;

wherein the first edge comprises a first male coupling part, wherein the second edge comprises a first female coupling part, wherein the first male coupling part and the first female coupling part are configured such that two of such panels, by their first male and first female coupling parts, can be coupled to each other in a plane and a coupled state can thus be realized between the panels;

wherein the first male coupling part comprises a first tongue;

wherein the first female coupling part comprises a first groove, wherein the first groove is delimited by a first front lip and a first rear lip;

wherein the first rear lip extends in a distal direction beyond an open or free end of the first front lip;

wherein the first tongue and the first groove, in the coupled state, form a tongue and groove connection that realizes a mechanical locking between the panels in the direction perpendicular to the plane of the panels;

wherein the first male coupling part and the first female coupling part each comprise a first locking part, which first locking parts, in the coupled state, realize a mechanical locking between the panels in the direction in the plane of the panels and perpendicular to the first pair of opposite edges;

wherein the first locking part of the first male coupling part is provided on a rear side of the first tongue;

wherein the first locking part of the first female coupling part is provided on a front side of the first rear lip; and wherein the panel comprises a second pair of opposite edges including a third edge and a fourth edge;

wherein the third edge comprises a second male coupling part, wherein the fourth edge comprises a second female coupling part, wherein the second male coupling part and the second female coupling part are configured such that two of such panels, by means of their second male and second female coupling parts, can be coupled to each other in a plane and a coupled state can thus be realized between the panels;

wherein the second male coupling part comprises a second tongue;

wherein the second female coupling part comprises a second groove, wherein the second groove is delimited by a second front lip and a second rear lip;

wherein the second rear lip extends in a distal direction beyond an open or free end of the second front lip, wherein the second tongue and the second groove, in the coupled state, form a tongue and groove connection that realizes a mechanical locking between the panels in the direction perpendicular to the plane of the panels;

wherein the second male coupling part and the second female coupling part each comprise a second locking part, which second locking parts, in the coupled state, realize a mechanical locking between the panels in the direction in the plane of the panels and perpendicular to the second pair of opposite edges;

wherein the second locking part of the second male coupling part is provided on a rear side of the second tongue;

wherein the second locking part of the second female coupling part is provided on a front side of the second rear lip;

wherein a first length of the first locking part of the first rear lip measured in a direction perpendicular to the second edge of the first pair of opposite edges and in a plane parallel to a front edge of the panel is greater than a second length of the second locking part of the second rear lip measured in the direction perpendicular to the fourth edge of the second pair of opposite edges and in the plane parallel to the front edge of the panel;

wherein the first male coupling part and the first female coupling part are configured such that they can be coupled by an angling movement;

wherein the second male coupling part and the second female coupling part are configured such that they can be coupled by an angling movement.

2. The wall or ceiling panel as in claim 1, wherein a first distance measured perpendicular to the plane of the panel between a front point of the first locking part of the first female coupling part and a rear point on a front edge of the first rear lip is greater than a second distance measured perpendicular to the plane of the panel between a front point of the second locking part of the second female coupling part and a rear point on a front edge of the second rear lip.

3. The wall or ceiling panel as in claim 1, wherein a front edge of the first locking part of the first female coupling part is parallel to a surface of the panel over at least half of its length as measured in the direction in the plane of the panel and perpendicular to the second edge of the panel;

wherein the front edge of the second locking part of the second female coupling part is curved over at least half of its length as measured in the direction in the plane of the panel and perpendicular to the fourth edge of the panel.

4. The wall or ceiling panel as in claim 1, wherein the first rear lip, on the rear side thereof, is provided with a first recess, wherein the second rear lip, on the rear side thereof, does not comprise a recess; or wherein the second rear lip on its rear side is provided with a second recess, wherein this second recess extends from the open or free end of the second rear lip in the direction perpendicular to the fourth edge and in the plane parallel to a surface of the panel over a shorter distance than the distance over which the first recess extends from the open or free end of the first rear lip in the direction perpendicular to the second edge and in the plane parallel to the surface of the panel.

5. The wall or ceiling panel as in claim 1, wherein the panel is oblong and the first pair of opposite edges is provided on long edges of the panel.

6. The wall or ceiling panel, as in claim 1, wherein the first locking part of the first female coupling part, distal to a location of the first locking part of the first female coupling part that is closest to a surface of the panel, comprises a zone that is parallel to the surface of the panel or that makes an angle of inclination of at most 5° with the surface of the panel, wherein this zone accounts for at least half of the first length of the first locking part of the first female coupling part measured in the direction perpendicular to the second edge.

7. The wall or ceiling panel as in claim 6, wherein an entire zone, in the direction perpendicular to the plane of the panel, lies at least 0.3 mm lower than the location of the first locking part of the first female coupling part that is closest to the surface of the panel.

8. The wall or ceiling panel as in claim 1, wherein the first edge, proximal to the first locking part of the first male coupling part, comprises a recess wherein this recess, perpendicular with respect to a surface of the panel, has a depth of at least 0.4 mm;

wherein a length of the recess in the direction perpendicular to the first edge is at least 0.3 mm.

9. The wall or ceiling panel as in claim 1, wherein the first rear lip is configured such that the first rear lip, or at least a part thereof, can bend backwards, even if the panel or the first rear lip is attached to a flat substructure.

10. The wall or ceiling panel as in claim 1, wherein a rear edge of the first rear lip, in the part that extends further than the first front lip, lies partially in the plane of the rear edge of the panel.

11. The wall or ceiling panel as in claim 1, wherein the panel shows one or a combination of two or more of the following characteristics:

the panel has a length of at least 2400 mm and the panel shows one or a combination of two or more of the following characteristics:

the panel has a width-to-length ratio greater than 1/10;

the panel comprises a water-resistant front and/or rear side;

the panel comprises on the front and/or rear side a melamine layer;

the panel comprises on the front and/or rear side a lacquer layer;

the panel comprises on the front and/or rear side a watertight foil;

the panel comprises as a core comprising a waterproof material.

12. The wall or ceiling panel as in claim 1, wherein the panel shows one or more of the following features:

an active locking zone defined by the first locking parts is situated, partially or fully, beyond the open or free end of the first front lip;

the part of the first rear lip that extends in a distal direction beyond the open or free end of the first front lip is longer than a thickness of the panel;

the first male coupling part and the first female coupling part are configured such that they can be coupled by a horizontal movement with a snap effect of one panel with respect to another such panel;

the first male coupling part and the first female coupling part are configured such that in the coupled state, they fit into each other with pretension; and/or the first male coupling part and the first female coupling part are made completely from a material of the panel, and in one part therewith.

13. The wall or ceiling panel as in claim 1, wherein the panel shows one or more of the following features:

an active locking zone defined by the second locking parts is situated, partially or fully, beyond the open or free end of the second front lip;

the part of the second rear lip that extends in a distal direction beyond the open or free end of the first front lip is longer than a thickness of the panel;

the second male coupling part and the second female coupling part are configured such that they can be coupled by a horizontal movement with a snap effect of one panel with respect to another such panel;

the second male coupling part and the second female coupling part are configured such that in the coupled state, they fit into each other with pretension; and/or the second male coupling part and the second female coupling part are made completely from a material of the panel, and in one part therewith.

14. The wall or ceiling panel as in claim 1, wherein the panel shows one or more of the following features:

the panel has a length between 1000 mm and 1500 mm;

the panel has a width between 300 and 450 mm;

a thickness of the panel is between 5 and 15 mm;

the panel is wood-based;

the panel comprises as a core a wood fiberboard;

the panel has a decorative front and/or rear side;

the panel is of a DPL or HPL type; and/or the panel has a finishable front and/or rear side;

the panel comprises a substrate, wherein this substrate comprises polyvinyl chloride, and optionally a filler;

the panel comprises a substrate, wherein this substrate comprises a matrix, wherein this matrix is formed by a mineral binder—and optionally wherein this substrate comprises one or more fillers.

15. The wall or ceiling covering, wherein the covering comprises a plurality of wall or ceiling panels as in claim 1, a substructure, and at least one fastening clip;

wherein the at least one fastening clip is fastened to the substructure;

wherein the at least one fastening clip is configured with an opening;

wherein the at least one fastening clip is fastened to the substructure;

wherein the opening is slid over at least a part of the first locking part of the first female coupling part of a first such panel;

wherein a second such panel is coupled by its first male coupling part to the first female coupling part of this first such panel;

wherein a third such panel is coupled at its third edge to the fourth edge of the first such panel by their respective coupling parts at their third and fourth edges;

wherein no fastening clips are provided on the second pair of opposite edges of the panels.

* * * * *